US011998153B2

(12) United States Patent
Post

(10) Patent No.: US 11,998,153 B2
(45) Date of Patent: Jun. 4, 2024

(54) HANDHELD CLEANING APPARATUS

(71) Applicant: Kenneth Post, West Bloomfield, MI (US)

(72) Inventor: Kenneth Post, West Bloomfield, MI (US)

( * ) Notice: Subject to any disclaimer, the term of this patent is extended or adjusted under 35 U.S.C. 154(b) by 376 days.

(21) Appl. No.: 17/125,006

(22) Filed: Dec. 17, 2020

(65) Prior Publication Data

US 2021/0196094 A1 Jul. 1, 2021

Related U.S. Application Data

(60) Provisional application No. 62/953,706, filed on Dec. 26, 2019.

(51) Int. Cl.

| | |
|---|---|
| ***A47L 13/12*** | (2006.01) |
| ***A47L 1/15*** | (2006.01) |
| ***A47L 13/256*** | (2006.01) |
| ***A47L 13/257*** | (2006.01) |
| ***A47L 13/28*** | (2006.01) |
| ***A47L 13/42*** | (2006.01) |

(52) U.S. Cl.

CPC ..... *A47L 13/12* (2013.01); *A47L 1/15* (2013.01); *A47L 13/256* (2013.01); *A47L 13/257* (2013.01); *A47L 13/28* (2013.01); *A47L 13/42* (2013.01)

(58) Field of Classification Search

None

See application file for complete search history.

(56) References Cited

U.S. PATENT DOCUMENTS

| | | | |
|---|---|---|---|
| 296,235 | A | 4/1884 | Sill |
| 672,584 | A | 4/1901 | Anderson |
| 1,325,400 | A | 7/1906 | Lightbrown |
| 1,084,184 | A | 1/1914 | Wenieke |
| 1,158,846 | A | 11/1915 | Punch |
| 1,378,243 | A | 5/1921 | Kracke |
| 1,675,736 | A | 7/1928 | Sturgis |
| 1,708,052 | A | 4/1929 | Channell |
| 1,716,171 | A | 6/1929 | Horihata |
| 1,916,649 | A | 7/1933 | Appleford |
| 1,989,921 | A | 2/1935 | Goddard |
| 1,993,571 | A | 3/1935 | Soderberg |

(Continued)

FOREIGN PATENT DOCUMENTS

| | | | |
|---|---|---|---|
| CH | 700702 | B1 | 10/2010 |
| DE | 10003899 | C1 | 9/2001 |

(Continued)

*Primary Examiner* — Natasha N Campbell

*Assistant Examiner* — Pradhuman Parihar

(74) *Attorney, Agent, or Firm* — The Dobrusin Law Firm, P.C.; Daniela M. Thompson-Walters

(57) ABSTRACT

A cleaning apparatus having a handle and a cleaning head. The cleaning head may include a base pivotably connected to the handle, a body affixed to the base and opposite the handle; and a cleaning material removably secured via clinging to the body opposite of the base and free of direct attachment to the base. The cleaning apparatus may find particular use in cleaning one or more surfaces which may include wiping, sweeping, dusting (e.g., dry, damp, or both), mopping (e.g., dry, damp, wet, or a combination), scrubbing, polishing, the like, or any combination thereof.

20 Claims, 4 Drawing Sheets

(56) References Cited

U.S. PATENT DOCUMENTS

| | | | |
|---|---|---|---|
| 2,127,886 | A | 8/1938 | Plon |
| 2,192,910 | A | 3/1940 | Hollenbeck |
| 2,291,435 | A | 7/1942 | Anderson |
| 2,301,586 | A | 11/1942 | Rubin |
| 2,304,127 | A | 12/1942 | Stetson |
| 2,315,325 | A | 3/1943 | Gavurin |
| 2,560,008 | A | 7/1951 | Steward |
| 2,646,588 | A | 7/1953 | Wagner |
| 2,682,071 | A | 6/1954 | Erik |
| 2,694,212 | A | 11/1954 | McGraw |
| 2,722,704 | A | 11/1955 | Warden |
| 2,764,774 | A | 10/1956 | Belsky |
| 2,790,193 | A | 4/1957 | Wilding |
| 3,099,855 | A | 8/1963 | Nash |
| 3,295,155 | A | 1/1967 | Belsky |
| 3,327,338 | A | 6/1967 | Young |
| 3,362,037 | A | 1/1968 | Griffin |
| 3,704,479 | A | 12/1972 | Whitaker |
| 3,761,991 | A | 10/1973 | Moss |
| 4,503,579 | A | 3/1985 | Nicely |
| 4,822,194 | A | 4/1989 | Simonette |
| 4,852,210 | A | 8/1989 | Krajicek |
| 4,926,522 | A | 5/1990 | Wang |
| 5,003,659 | A | 4/1991 | Paepke |
| 5,012,544 | A | 5/1991 | Verry |
| 5,095,574 | A | 3/1992 | Khanzadian |
| 5,177,831 | A | 1/1993 | Wirth |
| 5,333,347 | A | 8/1994 | Stranders |
| 5,556,470 | A | 9/1996 | Gruber |
| 5,596,787 | A | 1/1997 | Stevens |
| 5,603,138 | A | 2/1997 | Bonis |
| 5,657,507 | A | 8/1997 | Wasak |
| 5,876,141 | A | 3/1999 | Hsu |
| 5,918,342 | A | 7/1999 | Smith |
| 6,178,584 | B1 | 1/2001 | Post |
| 6,243,909 | B1 | 6/2001 | Graham |
| 6,523,213 | B1 | 2/2003 | Post |
| 6,543,951 | B1 | 4/2003 | Bauman |
| 6,769,153 | B1 | 8/2004 | Post |
| 6,795,999 | B1 | 9/2004 | Post |
| 6,928,687 | B2 | 8/2005 | Post |
| 6,973,695 | B1 | 12/2005 | Nesler |
| 7,231,684 | B2 | 6/2007 | Post |
| 7,343,698 | B2 | 3/2008 | Sugimoto |
| 7,401,346 | B2 | 7/2008 | Hayashi |
| 7,555,814 | B2 | 7/2009 | Lee |
| 7,581,273 | B2 | 9/2009 | Dobrin |
| 7,749,600 | B1 * | 7/2010 | Patrick ..... A47L 13/20 428/357 |
| 7,904,987 | B2 | 3/2011 | Bayon |
| 8,250,700 | B2 | 8/2012 | Pung |
| 8,407,848 | B2 | 4/2013 | Pung |
| 9,402,515 | B2 | 8/2016 | Post |
| 10,595,690 | B2 | 3/2020 | Post |
| 2003/0182751 | A1 | 10/2003 | White |
| 2004/0229557 | A1 | 11/2004 | Annis |
| 2004/0237240 | A1 | 12/2004 | Post |
| 2005/0034260 | A1 | 2/2005 | Post |
| 2005/0138742 | A1 | 6/2005 | Jaszenovics |
| 2006/0200933 | A1 | 9/2006 | McDonnell |
| 2007/0094829 | A1 * | 5/2007 | Dotterman ..... A47L 13/24 15/228 |
| 2007/0130710 | A1 | 6/2007 | Chen |
| 2007/0191502 | A1 * | 8/2007 | Free ..... C08G 18/7621 521/172 |
| 2007/0245509 | A1 | 10/2007 | Nesler |
| 2008/0022473 | A1 | 1/2008 | Risch |
| 2008/0034521 | A1 | 2/2008 | Probasco |
| 2008/0172817 | A1 | 7/2008 | Riddell |
| 2009/0025168 | A1 | 1/2009 | DeRoma |
| 2009/0106924 | A1 | 4/2009 | Park |
| 2009/0144923 | A1 | 6/2009 | Tuman |
| 2011/0020051 | A1 | 1/2011 | Robertson |
| 2013/0061414 | A1 | 3/2013 | Swist |
| 2014/0013531 | A1 | 1/2014 | Tuman |
| 2014/0237749 | A1 | 8/2014 | Yang |
| 2014/0259499 | A1 * | 9/2014 | Post ..... A47L 1/15 15/231 |
| 2015/0216386 | A1 * | 8/2015 | Baker ..... A47L 11/283 15/49.1 |
| 2016/0207190 | A1 * | 7/2016 | Balz ..... A46B 11/001 |
| 2017/0135546 | A1 * | 5/2017 | Apcar ..... A47L 13/44 |
| 2020/0129018 | A1 | 4/2020 | Post |

FOREIGN PATENT DOCUMENTS

| | | | |
|---|---|---|---|
| DE | 102006062686 | A1 | 6/2008 |
| EP | 0940310 | A2 | 9/1999 |
| EP | 2233055 | A2 | 9/2010 |
| FR | 1056318 | A | 2/1954 |
| GB | 109280 | A | 9/1917 |
| GB | 152089 | A | 10/1920 |
| GB | 406211 | A | 2/1934 |
| GB | 406800 | A | 3/1934 |
| GB | 904432 | A | 8/1962 |
| JP | 2007167092 | A | 7/2007 |
| WO | 92/19142 | A1 | 11/1992 |

* cited by examiner

HANDHELD CLEANING APPARATUS

FIELD

The present disclosure generally relates to a handheld cleaning apparatus. The handheld cleaning apparatus may be particularly useful for manual cleaning of floors, walls, and windows of homes, automobiles, and the like.

BACKGROUND

There are a number of different handheld tools on the market useful for cleaning surfaces, such as floors, walls, and windows. Cleaning may include dusting, polishing, mopping, sweeping, and the like. As an example, US Publication 2016/0332604, incorporated herein by reference in its entirety, discloses a simple and effective tool as a solution for cleaning surfaces such as windows which may be contoured and may have difficult to access corners and edges.

Some handheld tools require significant effort for affixing a cleaning attachment to the device. For example, a cleaning cloth may have to be snapped into retainers located on a cleaning head; an elastic band of a cleaning cloth may have to be stretched about at least a portion of a cleaning head; and/or temporary adhesive strips may have to be applied. While seemingly easy tasks, these may be difficult for those who struggle with fine motor skills, have sensitive fingers, weak nails, or even manicures. As can be imagined, those with arthritis, Parkinson's disease, recovering from a stroke, and the like, may struggle in affixing the cleaning attachment to a cleaning head due to the hand-eye coordination and small attachment mechanisms. Those with sensitive fingers, weak nails, or even manicures, may struggle to snap the cleaning cloths into the retainers without causing pain to their fingers, breaking a fingernail, or even ruining their manicure. Additionally, attachment for cleaning may require either an individual bending over to the floor or lifting the device closer for better visibility while also able to use their hands to attach the cloth. Thus, for individuals who may be injured (e.g., lower back injury, shoulder injury, etc.) or disabled (e.g., wheelchair-bound, crutches, using a walking aid), they may find it particularly challenging to find a position in which to affix the cleaning attachment to the device.

Other similar tools on the market may be designed using the "razor and blades" business model, meaning that while the cleaning device itself may be a one-time and reusable purchase, a cleaning attachment may only have a limited use. For example, a cleaning attachment such as a cloth, may be disposable and only useful for one-time use. Thus, while these tools may be effective at cleaning, they may be problematic at creating additional waste.

Additionally, there is always the need for simplifying cleaning tools in the home. Often, users have multiple tools to reach and clean multiple surfaces. Often, users may have a broom, mop, duster, polishing clothes, and even more. Each tool has a different cleaning material adapted to clean a specific surface and a specific handle length adapted for its use. As an example, a broom and mop have a longer handle than a duster. What is needed is a tool which is able to be easily configured to reduce the number of cleaning tools and is able to clean multiple surfaces.

Thus, what is needed is a cleaning apparatus which is simple to use and provides an environmentally-friendly method of cleaning surfaces, and/or or provides an easy disposable cleaning cloth. What is needed is a cleaning apparatus which is handheld and can have a cleaning attachment easily affixed thereto without the need of fine motor skills. What is needed is a cleaning apparatus which can be configured to clean a number of different surfaces at a variety of heights, from the floors to the walls to the ceiling, from glass to typical floor materials, and so forth.

SUMMARY

The present disclosure relates to a cleaning apparatus comprising: a) a handle; and b) a cleaning head having: i) a base pivotably connected to the handle; ii) a body affixed to the base and opposite the handle, wherein the body is formed of a compressible material; and iii) a cleaning material removably secured via clinging to the body opposite of the base and free of direct attachment to the base.

The cleaning apparatus of the present disclosure may include one or more of the following features in any combination: the body may be comprised of one or more body materials; the one or more body materials may comprise one or more foams, sponges, hook and loop material, or a combination thereof; the one or more body materials may include one or more foams which are one or more open-cell foams; the one or more body materials may include one or more foams which are porous with a porosity of about 30 ppi to about 100 ppi, the one or more body materials may include one or more foams comprising one or more polymeric materials including polyol, isocyanates, polyurethane (PUR), polystyrene (PS), polyvinyl chloride (PVC), polyethylene (PE), silicone, acrylonitrile butadiene styrene (ABS), compounds thereof, the like, or any combination thereof; the one or more body materials may be comprised of an ether-based polyurethane; the one or more body materials may have a thickness of about 0.1875 inches to about 0.5 inches; the one or more cleaning materials may include one or more inorganic materials, organic materials, or both; the one or more cleaning materials may comprise a plurality of fibers; the one or more cleaning materials may be washable and adapted to be reused; the one or more cleaning materials may include one or more polymeric materials which include polyamide, polyester, polystyrene, polyethylene, polycarbonates (PC), polypropylene, polyvinyl chloride, bio-based plastics/biopolymers (e.g., polylactic acid), silicone, acrylonitrile butadiene styrene (ABS), the like, or any combination thereof; the one or more cleaning materials may include microfiber, spunlace, or both; the one or more cleaning materials may be a split-microfiber; the one or more cleaning materials may be free of one or more attachment aids which provide an additional means of engagement to the body, engagement to the base, or both, the base may be pivotably connected to the handle via an omnidirectional joint; the omnidirectional joint may be a universal joint; the handle may have an adjustable length; the handle may include a plurality of handle portions for adjusting the length of the handle; the cleaning head may have a shape which is substantially cubed, rectangular prismed, triangle prismed, cylindrical, spherical, pyramidal, coned, the like, or any combination thereof; the base may have a two-dimensional profile shape which is substantially a square, rectangle, circle, triangle, pentagon, trapeze, polygon, ellipse, hexagon, octagon, rhombus, semicircle, or any combination thereof; the base may include one or more corners as part of the two-dimensional profile shape; one or more corners may be angled downward such that a peripheral edge, top surface, and bottom surface at the one or more corners is angled downward relative to the peripheral edge, bottom surface, and top surface part of a central portion of the base.

The present disclosure may further relate to a kit for the cleaning apparatus according to the teachings herein.

The present disclosure may further relate to a method of using the cleaning apparatus according to the teachings herein.

The present teachings provide a cleaning apparatus which is simple to use for cleaning a variety of surfaces. The cleaning apparatus may be compatible with a plurality of cleaning materials so that the cleaning material is able to be changed for type of cleaning. The cleaning materials may be washable, reusable, or both providing an environmentally-friendly means of cleaning surfaces. The cleaning materials may only be one-time use and provide a quick and rapid means of both adhering and disposing of the cleaning cloths. The body and the cleaning material may be able to easily cling to one another without the need for additional attachment aids. As the need for additional attachment aids or mechanisms is avoided, those with fine motor skills challenges or other finger concerns (e.g., weak nails, manicures) are able to easily apply, change, and remove the cleaning material from the cleaning head. By eliminating the need for additional attachment aids, the cleaning material may be able to be applied in a more simple and efficient manner, and thus faster. This can be a significant time-savings for quick clean-up projects that may otherwise be avoided due to the hassle associated with the tedious task of engaging the cleaning material into a plurality of retainers. The cleaning head may include an adjustable handle. With the adjustable handle, the cleaning apparatus may be able to be easily configured to clean a number of different surfaces at a variety of heights, from the floors to the walls to the ceiling, from glass to typical floor materials, and so forth.

DETAILED DESCRIPTION

Figure 1:
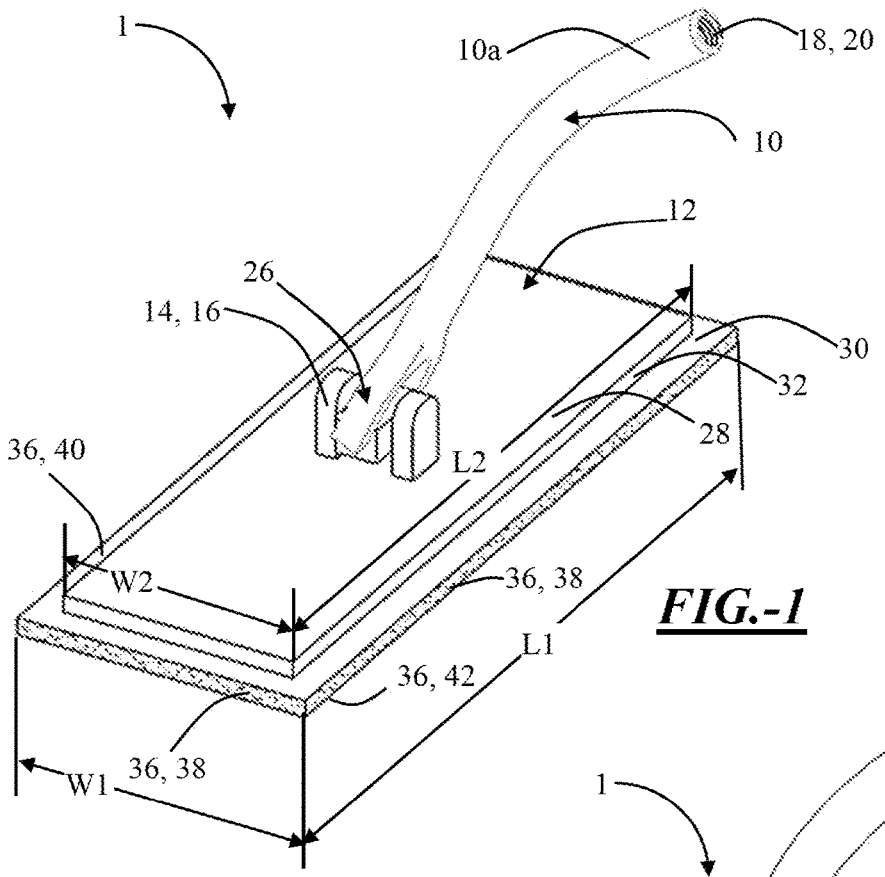
FIG. 1 is a perspective view of a handheld cleaning apparatus.

The present teachings meet one or more of the above needs by the improved devices and methods described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

Cleaning Apparatus

The present disclosure relates to a cleaning apparatus. The cleaning apparatus may be beneficial in allowing a user to clean one or more surfaces. Cleaning may include wiping, sweeping, dusting (e.g., dry, damp, or both), mopping (e.g., dry, damp, wet, or a combination), scrubbing, polishing, the like, or any combination thereof. The one or more surfaces may be located below, at, or above the maximum reach zone of a user. Maximum reach may be defined as the maximum distance a hand of a user can reach measured from their shoulder, center of body, or both. A maximum reach zone may be defined by human factors. Maximum reach may be 30 inches or greater, 35 inches or greater, 40 inches or greater, or even 44 inches or greater beyond the body (e.g., center and/or shoulder of body) of the user in a horizontal direction. Maximum reach may be about 60 inches or less beyond the body of the user in the horizontal direction. Maximum reach may be about 12 inches or greater, about 15 inches or greater, 20 inches or greater, or even 24 inches or greater beyond the shoulder of a user in the vertical direction. Maximum reach may be about 36 inches or less beyond the shoulder of a user in the vertical direction. The one or more surfaces may be located within one or more residential structures (e.g., home, apartment, etc.), commercial structures (e.g., restaurant, office, etc.), vehicles (e.g., car, truck, train, plane), outdoors (e.g., deck, patio, porch, etc.), the like, or any combination thereof. The one or more surfaces may include one or more floors, walls, ceilings, windows, glass, furnishings, panels (e.g., body panels), the like, or any combination thereof. The cleaning apparatus may be beneficial in allowing for multiple forms of cleaning on multiple surfaces by changing and/or cleaning a body, cleaning material, or both. For example, a first cleaning material may allow for a user to dust floors while a second cleaning material may allow for a user to then mop the same floors. As another example, a first cleaning material may allow for a user to dust floors while either the same or a second cleaning material may allow for the user to polish mirrors or glass. The cleaning apparatus may be beneficial as it may allow for a user to modify the length of the cleaning apparatus to clean surfaces at different heights or distances. For example, a shorter length of a handle may be used to clean windows while a longer length of a handle may be used to clean floors and ceilings. The cleaning apparatus may include one or more cleaning heads, handles, or both. The cleaning apparatus may include one or more bases, bodies, cleaning materials, joints, handles, the like, or any combination thereof.

The cleaning apparatus may include a cleaning head. The cleaning head may function to clean one or more surfaces, cooperate with a handle to allow for a user to manipulate the cleaning apparatus, conform to the shape of one or more surfaces, or a combination thereof. The cleaning head may have any shape and/or size suitable for cleaning one or more surfaces. The cleaning head may have a shape suitable for cleaning flat surfaces, curved surfaces, contoured surfaces, the like, or any combination thereof. The cleaning head may have a shape which is suitable for fitting into narrow spaces, around furnishings, into tight corners, the like, or a combination thereof. The cleaning head may have a shape which is substantially cubed, rectangular prismed, triangle prismed, cylindrical, spherical, pyramidal, coned, the like, or any combination thereof. The cleaning head may have one or more corners or be free of corners. The one or more corners may be formed at one or more apexes and/or vertexes. The cleaning head may be substantially rigid, partially rigid, elastic, flexible, or a combination thereof. The cleaning head may include one or more bases, bodies, cleaning materials, joints, or any combination thereof. The cleaning head may be compatible with a plurality of cleaning materials which are interchangeable as part of the cleaning head. The cleaning head may comprise a base affixed to and providing support to a body. The cleaning head may comprise a cleaning material removably attached to the body. The cleaning material may be located substantially opposite the base. The cleaning head may comprise a cleaning material free of attachment to the base. The cleaning head may comprise at least a portion of a joint. The joint may be part of the base. The joint may be located opposite the body relative to the base. The cleaning head may be affixed to a handle. The cleaning head may be movable relative to the handle. The handle may be omnidirectionally connected to the base. The cleaning head may comprise a layered arrangement of the base, body, and cleaning material with the body located between the base and cleaning material.

The cleaning head may include one or more bases. A base may function to provide support for one or more joints, handles, bodies, cleaning materials, or a combination thereof. A base may function to connect a body to handle. A base may function to transfer force applied to a handle by a user. A base may function to transfer force applied by a user to a body, cleaning material, or combination thereof. The base may function to flex a portion or an overall shape of the cleaning head. The base may function to flex a portion or an overall shape of the cleaning head to have a contour similar to the contour of one or more surfaces being cleaned. The base may have any suitable shape for providing support for one or more bodies, cleaning materials, joints, handles, or a combination thereof. The base may have any suitable shape for cleaning one or more surfaces. One or more surfaces may include a plurality of different surfaces. The base may have a two-dimensional profile shape. The two-dimensional profile shape may be the shape from a top plan view of the base (such as down from a handle). The two-dimensional profile shape may substantially be a rectangle, square, circle, triangle, pentagon, trapeze, polygon, ellipse, hexagon, octagon, rhombus, semicircle, the like, or any combination thereof. The two-dimensional profile shape may include or be free of one or more corners (e.g., vertices). A profile shape having one or more corners (e.g., rectangle, triangle, hexagon) may be useful in cleaning surfaces that are formed in or within corners (e.g. floor in a room corner, window corner, etc.). The base may have a three-dimensional shape which is substantially concave, flat, or both. The base may include one or more surfaces, edges, or a combination thereof.

The base may include an upper surface opposing a bottom surface. The upper surface may function to cooperate with a handle, joint, or both. The bottom surface may function to cooperate with a body, cleaning material, surface being cleaned, or a combination thereof. The upper surface may face toward a handle. The upper surface may be pivotally affixed to a handle. The upper surface may include one or more portions of a joint formed thereon. The upper surface may have one or more hinges, receivers, or both formed thereon, affixed thereto, or both. The one or more portions of the joint may be centered, off-center, or both on the upper surface. The bottom surface may face toward a body. The bottom surface may be permanently, semi-permanently, or both attached to one or more bodies. The bottom surface may be attached to an upper face of a body. The upper surface, bottom surface, or both may be substantially smooth, variable, irregular, the like, or a combination thereof. One or more surfaces of the base may be substantially smooth to avoid collecting and accumulating debris during cleaning. One or more surfaces of the base may include undulations to promote better adhesion. For example, the bottom surface may be grooved to provide greater surface area for application of an adhesive and semi-permanent and/or permanent adhesion to the body. The distance from bottom surface and the upper surface may be a height (e.g., thickness) of the base. The bottom surface, upper surface, or both may be part of one or more central portions, corners, or both. The bottom surface and the upper surface may extend out to a peripheral edge of the base.

The base may include a peripheral edge. The peripheral edge may define an outer boundary of the base. The peripheral edge may have a thickness (e.g., height) which is the same, equal to, or less than a height of the central portion. The peripheral edge may or may not include a peripheral lip.

A peripheral lip may extend around all or a portion of the base. A peripheral lip may be continuous, discontinuous, or both. A peripheral lip may only be located at one or more, two or more, or all of the side edges, corner edges, or a combination thereof of the base. A peripheral lip may only be located at two opposing side edges of the base. A peripheral lip may encapsulate at least a portion of the body therein. A peripheral lip may be adjacent to, in contact with, or both at least a pan of one or more side faces of a body. A peripheral lip may project upward, downward, or both such as away from the bottom and/or upper surface. Upward may be defined as toward a handle. Downward may be defined as away from the handle, toward a body, or both. A peripheral lip may have a height greater than the remainder of the base. A peripheral lip may have a height smaller than, equal to, or greater than or a combination thereof a height of the remainder of the body. A peripheral lip may have a height smaller than, equal to, greater than, or a combination thereof relative to a central portion of the body. A height of the peripheral lip may be measured as the distance from the bottom surface and/or upper surface of the base to a distal end of the peripheral lip. A peripheral lip may extend beyond the bottom surface (e.g., have a height of) by about 0.01 inches or greater, about 0.3 inches or greater, about 0.6 inches or greater, or even about 0.625 inches or greater. A peripheral lip may extend beyond the bottom surface by about 3 inches or less, 2 inches or less, or even 1 inch or less.

The base may be free of a peripheral lip. By being free of a peripheral lip, a maximum surface area of one or more side faces of a body may be exposed. By being free of a peripheral lip, an entire surface area of each side face of a body is available for removably adhering to one or more cleaning materials.

The peripheral edge may include one or more side edges, corner edges, or both. One or more side edges may be substantially linear, have a continuous arc radius, or both. One or more side edges may substantially define the overall two-dimensional profile shape of the base. One or more side edges may be located adjacent to, opposite from, or even be skewed relative to one or more other side edges. One or more side edges may be located in between two or more corner edges. One or more side edges may connect one or more corner edges to one or more other corner edges. One or more corner edges may define one or more corners of the base. One or more corner edges may form one or more vertices. One or more corner edges may form one or more tips, sharp corners, rounded corners, the like, or any combination thereof. One or more corner edges may form an angle, radius, or both. The one or more corner edges may have a smaller radius than one or more side edges (e.g., if the side edges are arcuate). The one or more corner edges may have a radius from about 0.25 mm or greater, about 0.5 mm or greater, or even about 1 mm or greater. The one or more corner edges may have a radius from about 20 mm or less, about 19 mm or less, or even about 18 mm or less. The one or more corner edges may define one or more rounded corners, tips, or both. The one or more corner edges at a tip may have a smaller radius than one or more corner edges at a rounded corner. The one or more corner edges may not define a central portion. The one or more corner edges may or may not be angled relative to the one or more side edges. One or more corner edges may be positioned at the same angle, a downward angle, or both relative to the side edges, upper surface, bottom surface, or a combination thereof. One or more corner edges may be positioned at the same angle, a downward angle, or both relative to the side edges, upper surface, bottom surface, or a combination thereof of a central portion.

The base may include a central portion. The central portion may function as the majority of the surface area of the base, to sustain one or more joints or portions thereof, to adhere to one or more bodies, to allow for force to be transferred from one or more handles to one or more bodies and/or cleaning materials, or any combination thereof. The central portion may have one or more substantially planar surfaces. The central portion may be defined where the upper surface, bottom surface, or both are substantially planar. The central portion may be defined by one or more peripheral edges. The central portion may be defined by one or more side edges, corner edges, or both. The central portion may include or be separate from one or more corners, corner edges, or both. The central portion may be at an angle compared to one or more corners. The angle may be acute, perpendicular, obtuse, equal to, or any combination thereof. The central portion may have a continuous height, varying height, or a combination thereof. The central portion may have a continuous height, tapered height (e.g., decreasing), increasing height, or any combination thereof from a center of the central portion toward one or more side edges. The height of the central portion may be a height suitable for the base. The central portion may be contained within or be free of from one or more corners.

The base may include one or more corners. The one or more corners may function to support a portion of a body, extend into corners of surfaces for cleaning, flex to allow the cleaning head to conform to a contoured cleaning surface, flex to allow maximum contact between a cleaning material and a surface being cleaned, or any combination thereof. The one or more corners may include, be separate from, or both one or more portions of the upper surface, bottom surface, or both. One or more corners may be a portion of the base where one or more edges meet at a corner edge, a portion of the upper surface and bottom surface defined within a corner edge, or both. One or more corners may be defined by the upper surface, bottom surface, or both being substantially planar, arcuate, or both. One or more corners may be defined where the upper surface, bottom surface, one or more corner edges, or a combination thereof are at an angle relative to the upper surface, bottom surface, or both of a central portion, one or more side edges, or a combination thereof.

The one or more corners may be defined where the peripheral edge, upper surface, bottom surface, or a combination thereof are angled relative to a central portion, one or more side edges, or both. One or more downward angled corners may allow for force received via a handle, a centrally located joint (such as an omnidirectional, universal joint), or both to be more evenly distribute across the cleaning head and surface being cleaned. Angled may mean angled downward. Angled downward may include an angle which is acute, perpendicular, obtuse, or a combination thereof relative to a bottom surface, top surface, or both of the central portion. The one or more corners may be defined where the slope of the base changes to provide for the angle. The one or more corners may be defined where the angle (e.g., slope) changes at the upper surface, bottom surface, or both of the central portion. The angle of the one or more corners may give the base a concave shape. The one or more corners may have an arcuate downward bend relative to one or more side edges, the bottom surface, the upper surface, or a combination thereof.

The one or more corners may include one or more rounded corners, tips, or both. One or more tips may have a smaller radius than one or more rounded corners. The one or more tips may be particularly useful in cleaning small spaces, along edges, in corners, or a combination thereof of one or more surfaces being cleaned. The bottom surface at the one or more corners may be affixed to, in contact with, or be free of attachment and/or contact with one or more bodies. One or more different profile shapes of the base may include a variety of corner shapes. A substantially triangle shaped base may include three rounded corners. A substantially triangle shaped based may include two rounded corners opposite a tip. A rectangular shaped base may include four rounded corners. A substantially rectangular shaped base may include three rounded corners and a tip. A substantially rectangular shaped base may include two tips and two rounded corners. For example, two adjacent corners may be tips while two adjacent corners may be rounded corners. As another example, the rounded corners may be in an alternating pattern with the tips.

A base may include or be free of one or more attachments. The one or more attachments may function to removably retain one or more cleaning materials retained to the base. The one or more attachments may have any shape and/or size suitable for at least temporarily retaining one or more cleaning materials to the base. The one or more attachments may include one or more hook and loop fasteners, clips, tabs, hooks, pins, snap fasteners, adhesive strips, the like, or any combination thereof. The base may be free of one or more attachments. The body may cooperate with the cleaning material to removably sustain the cleaning material without the aid of one or more attachments as part of the base. Eliminating the one or more attachments provides for a simpler design in the cleaning head, eliminates additional components in manufacturing, and eliminates additional steps in assembling the cleaning material as part of the cleaning head. Eliminating the one or more attachments alleviates the need for a user to either bend down to the cleaning head, lift the cleaning apparatus, or even reach the cleaning head to apply the cleaning material onto the cleaning head. Being free of one or more attachments facilitates the easier attachment of the one or more cleaning materials for those with disabilities, reduced fine motor skills, and the like. The one or more attachments may be located on surface of the base. The one or more attachments may be located on a bottom surface, upper surface, or both of the base. For example, a plurality of attachments may be located on an upper surface of the base. The one or more attachments may also be part of one or more bodies. For example, one or more attachments may be affixed to an upper face of one or more bodies.

The base may include a length, width, height, or a combination thereof. In the instance the base includes a diameter, the diameter may be referred to as the length, the width, or both. A length, width, or both of a base may be long enough to provide sufficient surface area to support a body on a bottom surface, allow for the body to extend beyond the base about at least a portion of a periphery of the base; provide sufficient area for one or more joints, or portions thereof to extend from a surface of the base, or any combination thereof. A length, width, or both may be measured as a distance from a peripheral edge to an opposing peripheral edge. A length, width, or both may be about 1 inch or greater, about 2 inches or greater, about 2.5 inches or greater, or even about 3 inches or greater. A length, width or both may be about 15 inches or less, about 12 inches or less, about 10 inches or less, or a combination thereof. As an example, a width of the base may be about 2 to 4 inches while a length of the base may be about 6 inches to 12 inches. A length, width, or both of the base may be smaller than, about equal to, and/or larger than a length, width, or both of a body. The length, width, or both of the base may be smaller than then length, width, or both of a body so that the body extends beyond at least a portion of the periphery of the base. A height of the base may allow the base to be sufficiently rigid while still having some flexibility. The flexibility may allow at least a portion of the base to bend and have a contour reciprocal with a contour of the surface being cleaned with the cleaning apparatus. A height of the base may be measured as the distance from the bottom surface to the upper surface. A height of the base may be about 0.03 inches or greater, about 0.04 inches or greater, about 0.06 inches or greater, or even about 0.0625 inches or greater. A height of the base may be about 1 inch or less, about 0.75 inches or less, about 0.6 inches or less, or even about 0.5 inches or less. For example, a height of a base may be about 0.0625 inches to about 0.5 inches. A height of the base may be substantially uniform, variable, or a combination of both about the entire The base may be comprised of one or more base materials. The one or more base materials may be any material suitable for allowing the base to support one or more joints, handles, bodies, cleaning materials, or a combination thereof. The one or more base materials may allow for the base to be substantially rigid while still having some flexibility. The one or more base materials may allow for the majority of the base to be rigid and provide structural support for a body, joint, handle, and/or cleaning material. The one or more base materials may also allow for one or more portions of the base to be at least partially flexible, elastomeric, or both. The one or more base materials may allow for one or more corners, even a plurality of corners, to bend upward such that their angle of bend is reduced. The one or more base materials may include a metal, a polymeric material, or both. Polymeric material may be any material which may be molded. For example, the polymeric material may be injection molded. Polymeric material may include a thermoset polymer, a thermoplastic polymer, or a combination thereof. Polymeric material may include polyamide, polyester, polystyrene, polyethylene (including polyethylene terephthalate, high density polyethylene and low density polyethylene), polycarbonates (PC), polypropylene, polyvinyl chloride, bio-based plastics/biopolymers (e.g., polylactic acid), silicone, acrylonitrile butadiene styrene (ABS), or any combination thereof, such as PC/ABS (blends of polycarbonates and acrylonitrile butadiene styrenes). The polymeric material may be reinforced with any known reinforcement material known for use with polymers. Reinforcement material may include fibers, microspheres, beads, bubbles, the like or any combination thereof. Reinforcement material may include glass, polymers, ceramic or carbon, the like, or any combination thereof.

The base may include one or more features of the cleaning head, paddle, or both as disclosed in US Publication No. 2016/0332604, incorporated herein in its entirety.

A cleaning head may include a body. A body may function to support a cleaning material, attract and retaining a cleaning material, provide a cleaning surface, provide a surface which contours to a surface being cleaned, or any combination thereof. The body may function to compress to be substantially reciprocal to one or more surfaces being cleaned. By compressing, the one or more cleaning materials are also able to be substantially reciprocal to the contours of the same surfaces. The body may have any suitable size and/or shape for allowing the cleaning head to cleaning one or more surfaces, sufficient surface area for cooperating with and engaging one or more cleaning materials, or both, sufficient surface area for being affixed to a body, or any combination thereof. The body may have a two-dimensional profile shape. The two-dimensional profile shape may be the shape from a top plane view of the body, the shape (profile) substantially parallel to the base, or both. The two-dimensional profile shape may be substantially similar or different than that of the base, cleaning material, or both. The two-dimensional profile shape may substantially be a rectangle, square, circle, triangle, pentagon, trapeze, polygon, ellipse, hexagon, octagon, rhombus, semicircle, the like, or any combination thereof. The two-dimensional profile shape may include or be free of one or more corners (e.g., vertices). A profile shape having one or more corners may be useful in cleaning surfaces that are formed in or within corners. The body may include a plurality of faces. The one or more faces may be the exposed surface areas of the body. The plurality of faces may include an upper face, lower face, one or more side faces, and the like. The upper face may be opposite the lower face. The upper face may face toward the base. The lower face may face toward one or more cleaning materials, one or more surfaces to be cleaned, or both. The one or more side faces may connect the lower face to the upper face. The one or more side faces may be the one or more peripheral surfaces of the body. For example, a body having a profile shape which is substantially rectangular may include an upper face opposite the lower face with four side faces. As another example, a body having a profile shape which is substantially triangular may include an upper face opposite a lower face with three side faces. And as another example, a body having a profile shape which is substantially elliptical or circular may have an upper face opposite a lower face and only a single side face that extends about the entire periphery of the body.

The body may be affixed to the base. The base may provide support for the body. The base may function to transfer force from the handle to the body. The body may be affixed to the base at the upper face. The upper face of the body may face toward and be adjacent to the bottom surface of the base. The upper face may be adhered to the bottom surface. The body may be affixed to the base via one or more adhesive materials, mechanical fasteners, the like, or any combination thereof. One or more adhesive materials may include one or more adhesive tapes, glues, or the like. The one or more adhesive materials may be animal-based, plant-based, solvent-based, synthetic, the like, or any combination thereof. The one or more adhesive materials may include an epoxy, acrylic, vinyl, acetate, acrylonitrile, cyanoacrylate, urethane, ethylene-vinyl acetate, polyester resins, polypropylene, the like, or any combination thereof. The base may be adhered to a substantially uniform surface of the body. For example, the lower surface may be parallel to and adhered to a substantially uniform (e.g., flat) upper face of the body. The base may be located within a well of the body. The body may have a well formed therein which is reciprocal with a least a portion of the base. The well may have a height (e.g., depth) which is about equal to or less than a height of the base. The well may result in the body being non-uniform (e.g., uneven) across the surface area of the upper face. The base may be centered or offset relative to the body.

The body may include a length, width, height, or a combination thereof. The dimensions of the body provide sufficient surface area for one or more cleaning materials to adhere to, allow for the body to compress to contours of one or more surfaces being cleaned, or both. The dimensions of the body allow for the cleaning apparatus to efficiently clean one or more surfaces, providing optimal force transfer from the handle and/or base to the body, allow the cleaning head to access constrained (e.g., tight) areas, or any combination thereof. A length, width, or both may be measured as the distance along one or more side faces, from one side face to an opposing side face, or both. The length, width, or both may be measured parallel to the upper face, lower face, or both. The length, width, or both of the body may be less than, about equal to, or even greater than a length, width, or both of the base. A length, width, or both may be about 1 inch or greater, about 2 inches or greater, about 2.5 inches or greater, or even about 3 inches or greater. A length, width or both may be about 15 inches or less, about 12 inches or less, about 10 inches or less, or a combination thereof. As an example, a width of the body may be about 2 to 4 inches while a length of the body may be about 6 inches to 12 inches. The body may have a length and/or width substantially equal to those of the base such that the one or more side faces of the body are substantially flush with the one or more peripheral edges of the base. Having about an equal length and/or width between the base and the body may provide for better control and transfer of force from the base to the body. The body may have a length and/or width greater to those of the base such that one or more side faces of the body extend beyond the one or more peripheral edges of the base. The body having a length and/or width greater than that of the base may allow for an upper face of the body to be partially exposed. A partially exposed upper face may provide additional surface area for attachment of a cleaning material to the body. The body may have a length and/or width which is about 5% or greater, about 10% or greater, about 50% or greater, about 75% or greater, or even about 100% or greater of the length and/or width of the base. The body may have a length and/or width which is about 2,000% or less, about 1,500% or less, about 1,000% or less, about 500% or less, about 200% or less, about 150% or less, or even about 125% or less of the length and/or width of the base. As an example, the body may have a length and/or width which is about 90% to 150% of the length and/or width of the base. As another example, the body may have a length and/or width which is about 100% to about 120% of the length and/or width of the base. A range of about 100% to about 120% may allow for the one or more side faces to be flush or extend just a portion beyond the peripheral edges of the base.

A height (e.g., thickness) may allow for a body to conform to contours of a surface being cleaned, compress to accommodate such contours, allow for force from the base to be transferred to the cleaning material without having a significant loss due to compression, or any combination thereof. A height of the body may be about 0.01 inches or greater, 0.05 inches or greater, about 0.0625 inches or greater, about 0.125 inches or greater, or even 0.1875 inches or greater. A height of the body may be about 3 inches or less, about 2.5 inches or less, about 2 inches or less, about 1.5 inches or less, about 1 inches or less, or even about 0.5 inches or less. For example, a height of the body may be about 0.125 inches to 1 inch. As another example, the height of the base may be about 0.1875 inches to about 0.5 inches. A height of 1 inch or greater, or greater than 0.5 inches may result in semi-permanent or event permanent during work applications (i.e., cleaning one or more surfaces). For example, the cleaning apparatus may be used to clean glass of a window. If the height of the body is greater than the thickness of the frame, the edges of the body may be deformed while cleaning the glass along the frame due to being unevenly pressed against the frame. In more detail, only a portion of a height of the body pushes against the window frame, while a portion of the body remains free of contact with the frame, leading to an uneven wear pattern along the side faces of the body. Too small of a height may not provide sufficient surface area on the side faces to engage one or more cleaning materials, sufficient surface area for cleaning against perpendicular surfaces, or both. A height less than 0.625 inches, or even less than 0.125 inches may not provide sufficient surface area on the one or more side faces to engage with one or more cleaning materials. A height less than 0.625 inches, or even less than 0.125 inches may not provide sufficient surface area for adequately cleaning substantially perpendicular surfaces. Perpendicular surfaces may be where a floor meets a wall, window meets a frame, and the like. The height of the body provides for the cleaning material to be affixed over one or more side faces and the lower face, such that the cleaning material is able to clean along the corner formed by surfaces abutting to one another and forming an angle with one another. If sufficient surface area of the sidewalls is not available, dust and other debris may be pushed up against the perpendicular surface as they are not collected by the cleaning material at the bottom face of the body. Additionally, the height of the body relative to the height of the base is critical in the transferring of force from the base to the body. The body may have a height that is less than, equal to, or even greater than a height of the base. The body may have a height which is about 5% of or greater, about 10% of or greater, about 50% of or greater, about 75% of or greater, or even about 100% of or greater relative to the height of the base. The body may have a height which is about 10,000% of or less, about 5,000% of or less, 1,000% of or less, or even 300% of or less relative to the height of the base. As an example, the body may have a height which is about 20% to 200% of the height of the base. The height of the body may be uniform, variable, or both. Uniform may mean the height is substantially about the same throughout the whole body. Variable may include differing heights, a tapered thickness, an increasing thickness, or a combination thereof. For example, the body may taper in height toward the periphery.

The body may be comprised of one or more body materials. The one or more body materials may be any material suitable for allowing the body to support one or more cleaning materials, attract and retain the body to the base, affixing the body to the base, working as a cleaning material, or any combination thereof. The one or more body materials may have a long-life to allow for repetitive use over a period of years. The one or more body materials may or may not be absorbent. The one or more body materials may be resistant to moisture, temperature, chemicals, and the like to allow for a long life. The one or more body materials may be suitable for transferring force from the base to the cleaning material, for being sufficiently durable to repeatedly withstand cleaning, for being abrasive enough to aid the cleaning material in cleaning one or more surfaces, for being soft enough to not damage surfaces such as by scratching, and the like. The one or more body materials may compressible, elastic, porous, durable, soft, the like, or any combination thereof. The one or more body materials may comprise one or more foams, sponges, hook and loop material, the like, or any combination thereof. The one or more foams may be closed cell foam, open cell foam, or both. Open cell foam may be advantageous in that the foam may be softer and springier, thus allowing the foam to compress (e.g., deform) and easily navigate contours in the one or more surfaces to be cleaned and return to a pre-deformed shape after use. Open cell foam may be advantageous in that the foam is able to dry quicker if used with moisture for cleaning, such as damp dusting and wet mopping. Open cell foam may be advantageous in providing for better temporary adhesion with one or more cleaning materials. The one or more body materials may be porous. Porosity may be advantageous is enabling one or more fibers of one or more cleaning materials to engage with the body material. A porosity of the body material may be about 30 ppi or greater, about 40 ppi or greater, about 50 ppi or greater, or even about 60 ppi or greater. A porosity of the body material may be about 100 ppi or less, about 90 ppi or less, about 80 ppi or less, or even about 70 ppi or less. A porosity less than 30 ppi may present challenges with engaging the fibers of the cleaning material such that there are insufficient pores for the fibers to lock into. A porosity greater than 100 ppi may be too great such that there is insufficient surface area available for the fibers of the cleaning material to engage with. The one or more foams may be organic, inorganic, or both. One or more organic foams may include natural rubber, natural latex, coconut fiber, wool, cotton, the like, or any combination thereof. One or more inorganic foams may include one or more polymeric materials. One or more polymeric materials suitable for the body material may include polyol, isocyanates, polyurethane (PUR), polystyrene (PS), polyvinyl chloride (PVC), polyethylene (PE), silicone, acrylonitrile butadiene styrene (ABS), compounds thereof, the like, or any combination thereof. Polyurethane may be ester-based, ether-based, or a combination of both. An ether-based polyurethane may be beneficial in providing a less expensive material, withstanding hydrolysis (e.g., withstanding breakdown from contact with water, such as with damp or wet dusting and mopping), better compressibility and the ability to withstand permanent deformation compressed to ester-based polyurethane, and even a softer body material. The one or more body material may include one or more elastomers. The one or more elastomers may impart elastic properties on the one or more body materials to allow the body to temporarily deform (e.g., compress) and return to a non-deformed stated. The one or more elastomers may be one or more of the organic, inorganic, or both materials.

The body may include one or more features of the cleaning head, cleaning element, absorbent layer, or any combination thereof as disclosed in US Publication No. 2016/0332604, incorporated herein in its entirety.

The cleaning apparatus may include one or more cleaning materials. The one or more cleaning materials may function to clean one or more surfaces with or without the aid of a cleaning solution; attract and/or adhere to dust and other particles, attract and/or adhere to a body, be reusable; or any combination thereof. The one or more cleaning materials may have any suitable size and/or shape for cooperating with the body while providing for the cleaning of one or more surfaces. The one or more cleaning materials may be flexible, loose, pliable, stiff, rigid, the like, or a combination thereof. A loose and flexible cleaning material may be advantageous in conforming to the shape of and removably adhering to the one or more bodies, conforming to one or more contours of a surface being cleaned, or both. The one or more cleaning materials may have a shape similar or different to that of the base, body, or both. The one or more cleaning materials may have a shape which covers an entire lower face of a body when affixed to the body. The cleaning material may have a two-dimensional profile shape. The two-dimensional profile shape may be the shape from a top plan view of the cleaning material. The two-dimensional profile shape may be the shape of the cleaning material when it is laying flat on a surface, affixed to the body, or both. The two-dimensional profile shape may substantially be a rectangle, square, circle, triangle, pentagon, trapeze, polygon, ellipse, hexagon, octagon, rhombus, semicircle, the like, or any combination thereof. The one or more cleaning materials may have a plurality of surfaces. The surfaces may include a first surface and a second surface. The first surface may be opposite the second surface. One or more of the surfaces may function to clean one or more surfaces, cooperate with a body, or both. One or more surfaces, such as a first surface, may face toward, be in contact with, be removably secured to, or a combination thereof to the body. One or more surfaces may be in contact with, removably secured to, or both a lower face, one or more side faces, or a combination thereof of the body. The one or more surfaces may have a plurality of exposed fibers. The fibers may be useful in attracting, removably adhering to, clinging to, or a combination thereof one or more faces of a body, dust, debris, the like, or a combination thereof. The one or more cleaning materials may be stitched about a periphery to avoid unraveling, separation, or both of the one or more cleansing materials. The distance from the first surface to the second surface may be a thickness of the cleaning material.

The one or more cleaning materials may have a length and a width. The length and width may function to cooperate with the dimensions of the body, base, or both; provide sufficient surface area for cleaning one or more surfaces; provide sufficient surface area for adhering to the body; or any combination thereof. A length, width, or both may be measured as the distance along one or more edges, from one edge to an opposing edge, or both. The length, width, or both may be measured parallel to the substantially flat surfaces of the cleaning material. The length, width, or both of the cleaning material may be less than, about equal to, or even greater than a length, width, or both of the body, base, or both. A length, width, or both may be about 1 inch or greater, about 2 inches or greater, about 2.5 inches or greater, or even about 3 inches or greater. A length, width or both may be about 25 inches or less, about 20 inches or less, 15 inches or less, about 12 inches or less, about 10 inches or less, or a combination thereof. As an example, a width of the cleaning material may be about 4 to 10 inches while a length of the cleaning material may be about 6 inches to 20 inches. The cleaning material may have a length and/or width greater than the length and/or width of the body. This allows the cleaning material to fold and/or bend from being in contact with the lower face to also being in contact with and overlapping one or more side faces. The cleaning material may have a length and/or width about equal to or greater than a length and/or width of the body in addition to the height of one or more side faces of the body. For example, a length of the cleaning material may be equal to the length of the body plus two times the height of the body greater. As another example, a width of the cleaning material may be equal to the width of the body plus two times the height of the body or greater. By having a length and/or width greater than that of the body, the one or more cleaning materials can overlap and cooperate with one or more side walls to aid in cleaning one or more perpendicular surfaces or corners formed by perpendicular surfaces.

The one or more cleaning materials may be comprised of one or more cleansing materials. The one or more cleansing materials may function to clean one or more surfaces with or without the aid of a cleansing solution; attract and/or adhere to dust and other particles; attract and/or adhere to a body; be reusable; be washable; be biodegradable, or any combination thereof. The one or more cleansing materials may be suitable for dusting, mopping, general cleaning, or any combination thereof. The one or more cleansing materials may be absorbent, have liquid repellence (e.g., impermeable), or a combination of both. The one or more cleansing materials may be absorbent such that the material absorbs fluid, releases fluid during cleaning, or both. For example, while mopping, scrubbing, or otherwise, fluid absorbed within the material may be released due to pressure, compression, or both. The fluid may be useful to loosen and/or remove dirt and debris from one or more surfaces, sanitizing one or more surfaces, or both. The one or more cleansing materials may be suitable for applying a cleaning fluid to a surface to be cleaned, absorbing fluid from a surface to be cleaned, scrubbing one or more surfaces to loosen dust and debris, attracting and retaining dust and debris, or any combination thereof. The one or more cleansing materials may or may not be stretchable, elastic, soft, abrasive, flexible, washable, biodegradable, cushioned, the like, or any combination thereof. The one or more cleansing materials may be made of one or more recycled materials. The one or more cleansing materials may be suitable for using while dry, damp, wet, or a combination thereof. The one or more cleansing materials may be able to removably adhere to the body. The one or more cleansing materials may be useful for temporarily engaging with the body. The one or more cleansing materials may be formed by a plurality of fibers. The one or more cleansing materials may comprise one or more split-fiber materials. The one or more cleansing materials may be affixed to the body via a clinging engagement. A clinging engagement may include static clinging, fiber engagement with open cells (e.g., similar but more delicate attachment than hook and loop), the like, or a combination thereof. The one or more cleansing materials may include one or more textiles, porous materials, the like, or both. One or more textiles may be woven, non-woven, or a combination of both. One or more porous materials may include one or more materials suitable for use as the body. One or more cleansing materials may include one or more inorganic materials, organic materials, or both. One or more organic materials may include one or more plant-based materials, animal-derived materials, or both. One or more organic materials may include cotton, Tencel, hemp, soybean fiber, linen, bamboo, coconut, the like, or a combination thereof. One or more inorganic materials may include one or more polymeric materials. Polymeric material may include polyamide, polyester, polystyrene, polyethylene (including polyethylene terephthalate, high density polyethylene and low density polyethylene), polycarbonates (PC), polypropylene, polyvinyl chloride, bio-based plastics/biopolymers (e.g., polylactic acid), silicone, acrylonitrile butadiene styrene (ABS), the like, or any combination thereof. The one or more cleansing materials may include microfiber, spunlace, or both. Microfiber may be a split-microfiber. Microfiber may be woven, nonwoven, or both. For example, the one or more cleansing materials may be a woven microfiber comprising a blend of polyester and polyamide. As another example, the one or more cleansing materials may be a nonwoven spunlace fabric comprising a blend of polyester and polyamide. A blend of polyester and polyamide may have a ratio of about 50:50, 60:40, 75:25, or even about 80:20 of polyester to polyamide. Microfiber used as a cleaning material may be advantageous in providing an environmentally friendly, multiple-use cleaning material. Nonwoven spunlace may be particularly useful in providing one-time use materials which are quick to apply and dispose of. Nonwoven spunlace may or may not be comprised one or more recycled materials, may or may not be entirely or at least partially biodegradable, or a combination thereof.

The one or more cleaning materials may include or be free of one or more attachment aids. The one or more attachment aids may function to temporarily adhere (e.g., removably secure) the one or more cleaning materials to the base, body, or both; cooperate with one or more attachments of the base, or any combination thereof. The one or more attachment aids may include one or more elastics, hook and loop fasteners, clips, tabs, hooks, pins, snap fasteners, adhesive strips, the like, or any combination thereof. The one or more attachment aids may include an elastic. The one or more elastics may be located substantially about a peripheral edge of the one or more cleaning materials. The one or more elastic band. The one or more elastics may be attached about a periphery of the one or more cleaning materials. The one or more elastics may have a relaxed (e.g., non-stretched) state having a perimeter length smaller than the perimeter length of the cleaning material without the elastic. The one or more elastics may be used to affix the cleaning material to the base, body, or both. The one or more elastics may provide an elastic force for releasably securing the cleaning material to the base, body, or both. The one or more elastics may secure the cleaning material over the peripheral edge of the one or more bases. For example, the one or more elastics may function as described in US Publication No 2016/0332604 The one or more cleaning materials may be free of one or more attachment aids. The body may cooperate with the cleaning material to removably sustain the cleaning material without the assistance of one or more attachment aids. Eliminating the one or more attachment aids provides for a simpler design in the cleaning head, eliminates additional components in manufacturing, and eliminates additional steps in assembling the cleaning material as part of the cleaning head. Eliminating the one or more attachment aids allows for smaller cleaning material sizes and thus less material, less cost, and less waste. Less material may be utilized as the cleaning material does not need to overlap both the body and the base to also adhere to the base. Eliminating the one or more attachment aids alleviates the need for a user to either bend down to the cleaning head, lift the cleaning apparatus, or even reach the cleaning head to apply the cleaning material onto the cleaning head. Being free of one or more attachment aids facilitates the easier attachment of the one or more cleaning materials for those with disabilities, reduced fine motor skills, and the like.

The one or more cleaning materials may include any of the features, be used in any manner described, or both in US Publication No. 2016/0332604.

The cleaning apparatus may include one or more joints. One or more joints may function to connect one or more handles to the cleaning head. One or more joints may function to allow a user to manipulate an angle of the cleaning head relative to the angle, position the cleaning head flush to a surface for cleaning, allow a user to manipulate the cleaning head for affixing a cleaning material thereto, or any combination thereof. The one or more joints may be one-directional, bi-directional, multi-directional, even omnidirectional. The one or more joints may include one or more hinges, universal joints, swivel joints, the like, or any combination thereof. The one or more joints may include one or more receivers, hinges, shafts, swivels, or any combination thereof. The one or more joints may include on or more receivers. The one or more receivers may be hollow, partially hollow, solid, or a combination thereof. The one or more receivers may include one or more channels, bores, cradles, the like, or a combination thereof. For example, the one or more receivers may include two receivers, a first receiver and a second receiver distanced from one another. A first receiver may include a cradle formed therein. A cradle may mean that the receiver is a substantially solid shape and includes an arcuate outer shape which forms a concave portion therein. A second receiver may include a bore at least partially extending therethrough. The opening of the bore may face toward the first receiver and the cradle. The one or more receivers may function to receive a shaft, or portions thereof (e.g., one or more pins) therein. The shaft, or portions thereof, may be disposed within the bore of the second receive and the cradle of the first receiver. The shaft may be pivotable relative to the one or more receivers. The shaft may be formed as part of the handle, may be affixed to the handle, or both. The shaft may be substantially perpendicular to the longitudinal axis of the handle. The one or more shafts may be static, mobile, or both relative to the handle. The one or more shafts may include one or more pins. The one or more pins, the body of the shaft itself, or both may extend into the one or more bores, cradles, or both. An exemplary shaft, pin, and receiver hinge relationship is described in US Publication No. 2016/0332604. The one or more shafts may be connected to one or more hinges. The one or more hinges may be part of or connected to the base, handle, or both. The one or more hinges may include one or more U-shaped or H-shaped hinges. The one or more hinges may include a pair of hinges. One or more portions of the joint may be integrally formed, affixed to, or both as part of the base, handle, or a combination thereof. One or more receivers, hinges, shafts, swivels, or any combination thereof may be integrally formed, affixed to, or both as part of the base, handle, or a combination thereof. For example, one or more receivers may be integrally formed as part of the base and project away from the upper surface. As another example, one or more hinges may be integrally formed as part of the base and project away from the upper surface. As another example, one or more hinges may be formed at a distal end of the handle. A shaft may connect a hinge part of the base to a hinge part of the handle to provide for a universal joint. The joint may be off-center and/or centered with the base. A portion of the joint may spread across a width of the base or may be more centrally located. One or more downward angled corners of the base may allow for the joint to be centered, such as a multidirectional or even universal joint, while allowing the forces from the handle through the joint, to be more evenly distributed across the cleaning head. A smaller joint, such as a universal joint, may allow for the cleaning head to more easily access limited spaces while allowing a user to manipulate an angle of a handle relative to the cleaning head, the direction of the cleaning head, and force applied to the cleaning head.

The cleaning apparatus may include a handle. The handle may function to allow a user to hold and manipulate the cleaning apparatus, adjust the distance of the cleaning head from the user to clean a variety of surfaces, or a combination thereof. The handle may have any size and/or shape which allows a user to clean surfaces at a variety of distances from the user, a variety of surfaces that require different pressure applications, prevent the need for excessive reaching and/or stretching while cleaning, the like, or any combination thereof. The handle may have a form which is ergonomically friendly. The handle may be substantially tubular in form. The handle may have different shapes along its length. Shapes may include a U-shaped portion (e.g., hinge), square and/or rectangular cross-section along a portion of its length, tubular by a handgrip, include indentations for handgrips, the like, or any combination thereof. The handle may have a fixed length, adjustable length, or both. The handle may have an adjustable length. An adjustable length may allow the handle to have a shorter length (e.g., for closer cleaning, like a window or glass), a longer length (e.g., for more distance cleaning, like a floor or ceiling), or both. An adjustable length may allow the handle to transition between a shorter length and longer length. The handle may include one or more portions. One or more portions of a handle may function as segments of a handle. The one or more portions may function to adjust the length of the handle. One or more portions may reside within one another, be affixed to one another, be extendable from another portion, be removable connectable to another portion, or any combination thereof. The handle may be telescoping. Telescoping may mean that one or more portions of the handle may slide into, out of, or both one or more other portions to increase, decrease, or both the length of the handle. The handle may include one or more connector portions. One or more connector portions may function to connect one or more portions of a handle to one or more other portions of a handle. The one or more connector portions may be a plurality of threads, tabs, reciprocal contours, the like, or any combination thereof. The one or more connector portions may be located at one or more ends of one or more portions. For example, a proximal end of a first portion of a handle may have a plurality of interior or exterior threads which mate with a plurality of matching threads of a second portion of a handle formed on a distal end. The handle may include one or more grips. The one or more grips may provide an ergonomic, comfortable location for a user to hold the handle. The one or more grips may be in the form of any high friction, easily grippable material. The one or more grips may be located on a proximal end of the handle. The handle may include one or more portions of a joint. The one or more portions may include one or more hinges, shafts, retainers, the like, or any combination thereof. The one or more portions of a joint may be located at a distal end of the handle. The one or more portions may be integral with, affixed to, or both to the handle. The one or more handles may include one or more storage aids. One or more storage aids may be useful for storing the cleaning apparatus when not in use. One or more storage aids may include one or more openings, hooks, the like, or a combination thereof. One or more openings may be formed at a proximal end of a handle, handle portion, or both. One or more openings may be formed through one or more grips. One or more openings may be suitable for hanging the cleaning apparatus from a hook.

Kit for a Cleaning Apparatus

The present disclosure relates to a kit for a cleaning apparatus according to the teachings herein. The kit may provide for one or more of the components of a cleaning apparatus. The kit may include a plurality of the one or more components of a cleaning apparatus. The kit may include one or more handles, joints, bases, bodies, cleaning materials, cleaning fluids, fluid vessels, or any combination thereof. The kit may include a plurality of handle portions. The handle portions may be assembled, unassembled, or both within the kit. The kit may include a base. The base may include a joint, or a portion thereof. The base may be assembled, unassembled, or both to a handle, handle portion(s), or both within the kit. The kit may include one or more bodies. The kit may include a body affixed to a base. The kit may include one or more bodies in addition to the body affixed to the base. The one or more bodies may be unattached to the base. The one or more unattached bodies may function as replacement components if necessary. The kit may include one or more cleaning materials. The one or more cleaning materials may include a single or a plurality of cleaning materials. A plurality of cleaning materials may all be the same, different, or a combination thereof. A plurality of cleaning materials may provide one or more cleaning materials which are softer than others, more abrasive than others, more absorbent than others, or a combination thereof. For example, one or more cleaning materials may be suitable for dry dusting while other one or more cleaning materials may be suitable for wet mopping or scrubbing. The kit may include one or more fluid vessels. The fluid vessels may be suitable for retaining, releasing, or both one or more cleaning fluids. The one or more fluid vessels may be configured to be affixed to the handle, base, or both. The one or more fluid vessels may include one or more spray nozzles configured to release the one or more fluids. The kit may include one or more fluids. The fluids may be suitable for sanitizing, polishing, and the like one or more surfaces being cleaned. The fluids may include a household cleaning, disinfectants, polishes, the like, or any combination thereof. The kit may include a storage container. Each component of the cleaning apparatus may be located within the storage container. For example, the storage container may be a box for selling and/or distribution of the cleaning apparatus.

Method of Using Cleaning Apparatus

The present disclosure relates to a method of using a cleaning apparatus according to the teachings herein. The method may include assembling one or more components of a cleaning apparatus to one or more other components. For example, a handle may be affixed to a cleaning head. As another example, a body may be adhered to a base. The method may include applying one or more cleaning materials to one or more bodies. The method may include applying a first surface of a cleaning material to one or more faces of one or more bodies. The method may include applying a first surface of a cleaning material to a lower face of a body, one or more side faces of a body, or both. One or more side faces may include a single side, two or more sides faces, three or more side faces, four or more side faces, or even more. Two or more side faces may include opposing side faces. Applying a cleaning material to a body may include applying force to a cleaning material and a body simultaneously such that a plurality of fibers of the cleaning material engage (e.g., cling) with one or more cells, pores, or both of a body. Applying a cleaning material may include the user holding a cleaning material in one hand and the body, base, and/or handle in another hand. Applying a cleaning material may include the cleaning material being placed on a floor or other surface. Applying a cleaning material may include locating the body onto the cleaning material. Locating the body onto the cleaning material may include holding the body, base, and or handle in one hand to move the base toward the cleaning material in the other hand of the user. Locating the body onto the cleaning material may include holding the body, base, and or handle and moving the base the base toward the cleaning material located on the floor or another surface. Applying the cleaning material may include applying force onto the cleaning material, body, or both such that the cleaning material engages with the body. Applying force may include the user holding onto a handle, base, body, or a combination thereof and pushing toward the cleaning material, a floor or other surface, or both. For example, a user may hold the handle and push downward into the floor and cleaning material such that the cleaning material clings to the body. Applying force may include applying force onto one or more lower faces, side faces, or a combination thereof of the body while in contract with a cleaning material. Applying force may include a user directly, indirectly, or both applying force onto a one or more portions of a cleaning material in contact with one or more side faces such that the one or more portions of the cleaning material clings to the one or more side faces. Direct force may be a user using their hand to apply the force directly to the cleaning material and body. Indirect force may be moving the body and cleaning material toward a wall or other surface an pressing the cleaning material between the wall and face of the body.

The method of using the cleaning apparatus may include adjusting a length of a handle. Adjusting a length of a handle may include connecting one or more portions of a handle to one or more other portions. Connecting one or more portions may include engaging one or more connector portions to one or more other connector portions. Engaging may include threading a plurality of threads of one handle portion with a plurality of threads of another handle portion. Adjusting a length of a handle may include extending, contracting, or both one or more portions of a handle. Extending (e.g., lengthening) may include sliding one or more portions of a handle out of one or more other portions of the handle. Contracting (e.g., shortening) may include sliding one or more portions of a handle into one or more other portions of a handle.

The method of using the cleaning apparatus may include cleaning one or more surfaces. may include wiping, sweeping, dusting (e.g., dry, damp, or both), mopping (e.g., dry, damp, wet, or a combination), scrubbing, polishing, the like, or any combination thereof.

The method of using the cleaning apparatus may include changing one or more cleaning materials. Changing may include selecting another cleaning material. Changing may include removing a cleaning material. Changing may include applying another cleaning material. Applying may include any method described as suitable for applying a cleaning material. The method of using the cleaning apparatus may include washing, cleaning, disposing, and the like one or more cleaning materials already used for cleaning one or more surfaces.

Any of the features of U.S. patent application Ser. No. 15/222,227, filed Jul. 28, 2016, U.S. patent application Ser.

No. 14/216,563, filed Mar. 17, 2014; U.S. Provisional Patent Application No. 61/792,262, filed Mar. 15, 2013; U.S. Provisional Patent Application No. 61/879,819, filed Sep. 19, 2013; and U.S. Provisional Patent Application No. 61/896,734, filed Oct. 29, 2013, are incorporated herein by reference in their entirety.

Illustrative Examples

The following descriptions of the figures are provided to illustrate the teachings herein but are not intended to limit the scope thereof. One or more features illustrated in one or more figures may be combined with one or more features illustrated in one or more other figures. For example, the joint 14 shown with the universal joint 16 may be used in lieu of the joint 14 with receivers 50.

FIG. 1 illustrates a handheld cleaning apparatus 1 (also referred to as "cleaning apparatus"). The cleaning apparatus 1 includes a handle 10 affixed to a cleaning head 12. The handle 10 is affixed to the cleaning head 12 via a joint 14. The joint 14 is shown as a universal joint 16. The handle 10 includes an adjustable length. The handle 10 includes a first handle portion 10*a*. The handle 10 includes a connection portion 18. The connection portion 18 is part of the first handle portion 10*a*. The connection portion 18 is a plurality of threads 20. The connection portion 18 is configured to engage and mate with a second handle portion 10*b* (not shown). The distal end 26 of the handle 10 is the portion affixed to the joint 14. The joint 14 is affixed to the cleaning head 12. The joint 14 is affixed to a base 28. The base 28 is illustrated as having a substantially rectangular cross-section (top plan view, such as from handle). The cleaning head 12 includes a body 30. The body 30 is shown as a foam material. The body 30 includes a plurality of faces 36. The plurality of faces 36 include a plurality of side faces 38, an upper face 40, and a lower face 42. One face 36 is adjacent, facing toward the base 28. Specifically, the upper face 40 is adjacent and facing toward the base 28. The other faces 36 are all exposed. The body 30 also has a substantially rectangular cross-section (top plan view, such as from handle). The body 30 extends beyond a periphery 32 of the base 28. The body 30 has a width W1 and length L1 longer than that of the base 28.

Figure 2:
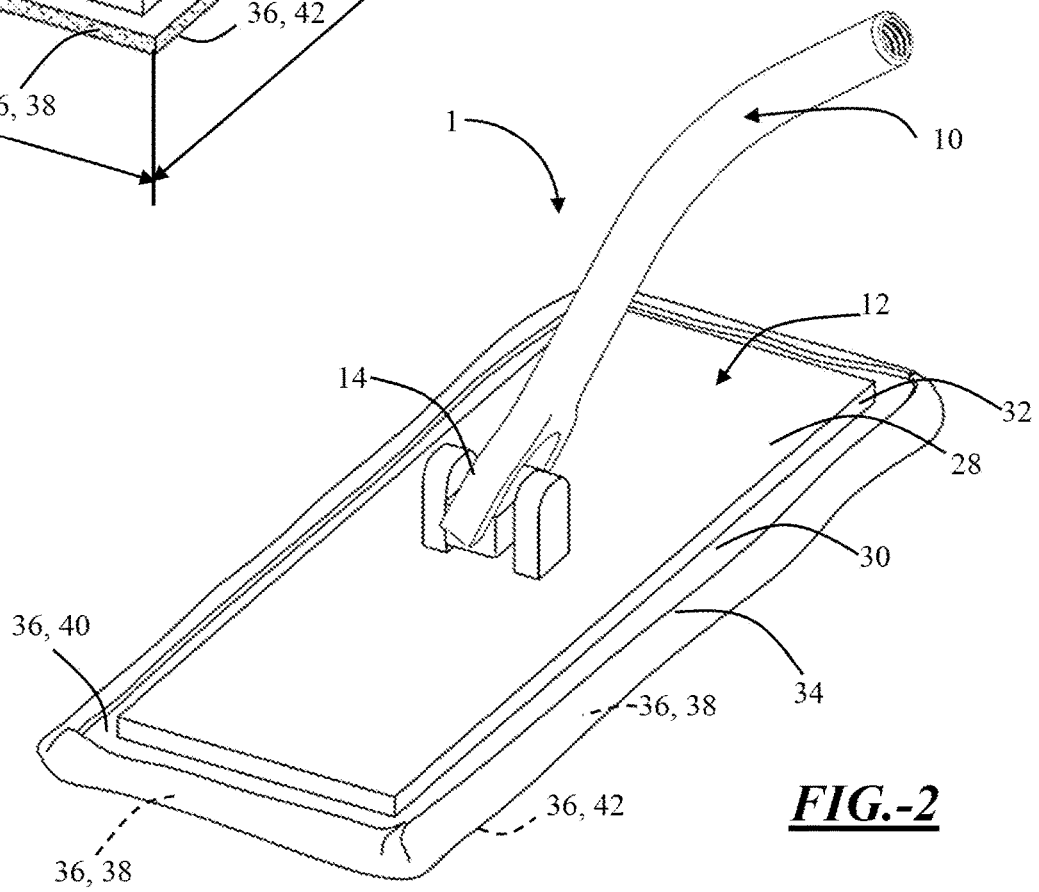
FIG. 2 is a perspective view of a handheld cleaning apparatus including a cleaning material.

FIG. 2 illustrates a handheld cleaning apparatus 1 (also referred to as "cleaning apparatus"). The cleaning apparatus 1 includes a handle 10 affixed to a cleaning head 12. The handle 10 is affixed to the cleaning head 12 via a joint 14. The joint 14 is affixed to the cleaning head 12. The joint 14 affixed to a base 28. The base 28 is illustrated as having a substantially rectangular cross-section. The cleaning head 12 includes a body 30. The body 30 is shown as a foam material. The body 30 also has a substantially rectangular cross-section. The body 30 extends beyond a periphery 32 of the base 28. It is also envisioned that the body 30 may be flush with the periphery 32 of the base 28. Attached and adjacent to the body 30 is a cleaning material 34. The cleaning material 34 is located on the body 30 opposite of the base 28. The cleaning material 34 is temporarily attached to the body 30. The cleaning material 34 is temporarily affixed to at least some of the plurality of faces 36 of the body. The cleaning material 34 is temporarily affixed to the lower face 42 (as shown in FIG. 1), and each of the side faces 38 (as shown in FIG. 1). The cleaning material 34 clings to the body 30 to provide for the temporary attachment. The cling may be provided by the fibers of the cleaning material 34 engaging with the open cells and/or pores formed in a foam of the body 30. The cleaning head 12 is free of any separate attachment features which affix the cleaning material 34 to the body 30. The cleaning material 34 is also temporarily affixed about a periphery of the upper face 40 of the body 30. As illustrated, the cleaning material 34 clings to the upper face 40 where the upper face 40 extends beyond the periphery 32 of the base 28.

Figure 3:
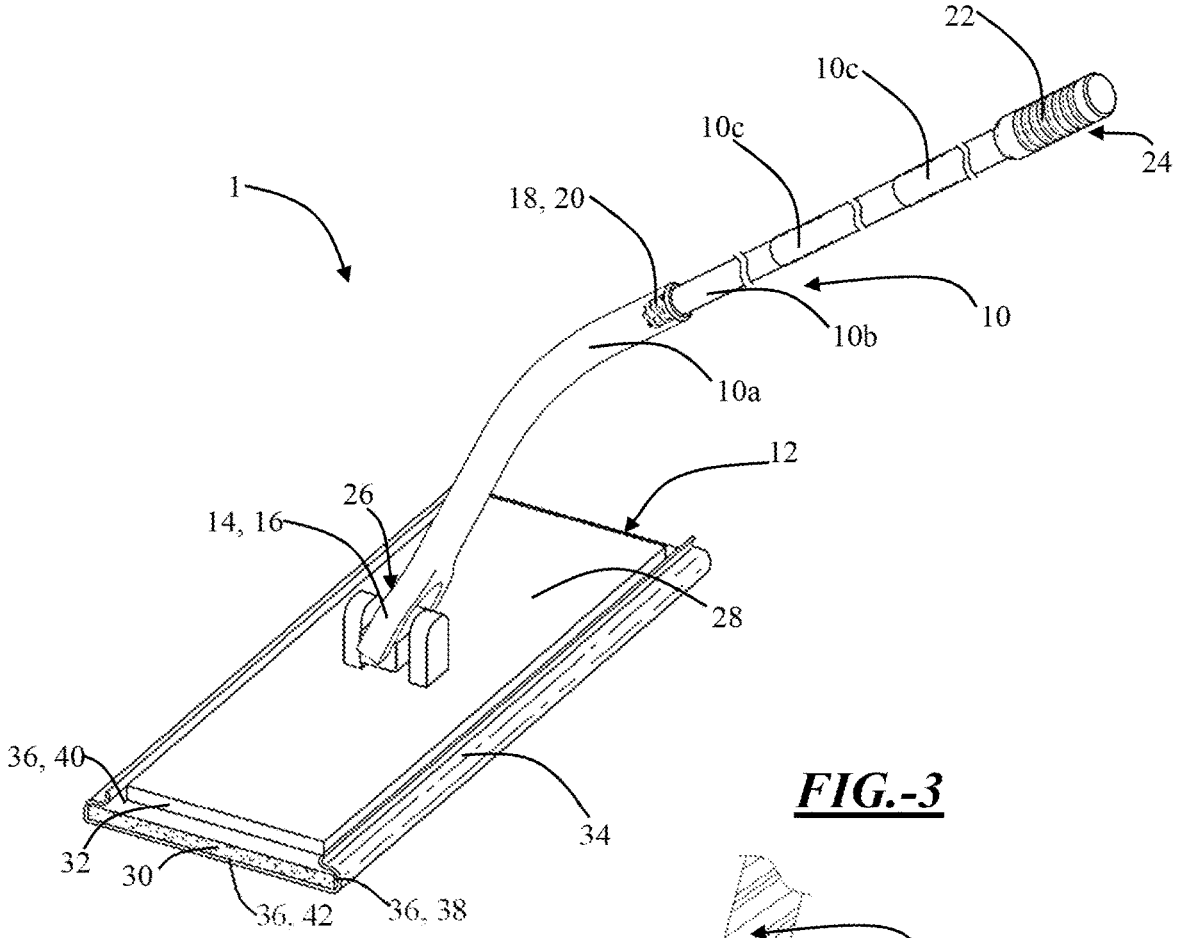
FIG. 3 is a perspective view of a handheld cleaning apparatus.

FIG. 3 illustrates a handheld cleaning apparatus 1 (also referred to as "cleaning apparatus"). The cleaning apparatus 1 includes a handle 10 affixed to a cleaning head 12. The handle 10 is affixed to the cleaning head 12 via a joint 14. The joint 14 is shown as a universal joint 16. The handle 10 includes an adjustable length. The handle 10 includes a first handle portion 10*a* The handle 10 includes a connection portion 18. The connection portion 18 is part of the first handle portion 10*a*. The connection portion 18 is a plurality of threads 20. The connection portion 18 is configured to engage and mate with a second handle portion 10*b*. The second handle portion 10*b* also includes a connection portion 18. The connection portion 18 of the second handle portion 10*b* includes a plurality of threads 20. The handle 10 is also telescoping. The handle 10 includes a plurality of sliding portions 10*c*. The sliding portions 10*c* are able to extend into and out of other sliding portions 10*c* of the handle 10 to shorten and/or increase the length of the handle 10. The handle 10 includes a grip 22. The grip 22 is located on a proximal end 24 of the handle 10. The proximal end 24 may be the portion of the handle 10 opposite the cleaning head 12. The proximal end 24 may be opposite the distal end 26 of the handle 10. The distal end 26 of the handle 10 is the portion affixed to the joint 14. The joint 14 is affixed to the cleaning head 12. The joint 14 affixed to a base 28. The cleaning head 12 includes a body 30. The body 30 is shown as a foam material. The body 30 also has a substantially rectangular cross-section. The body 30 extends beyond a periphery 32 of the base 28. Attached and adjacent to the body 30 is a cleaning material 34. The cleaning material 34 is located on the body 30 opposite of the base 28. The cleaning material 34 is temporarily attached to the body 30. The cleaning material 34 is temporarily affixed to at least some of the plurality of faces 36 of the body. The cleaning material 34 is temporarily affixed to the lower face 42 and some of the side faces 38. Specifically, the cleaning material 34 is affixed to the two side faces 38 along the length LI (as shown in FIG. 1 and FIG. 2) of the body 30. The cleaning material 34 clings to the body 30 to provide for the temporary attachment. The cleaning head 12 is free of any separate attachment features which affix the cleaning material 34 to the body 30. The cleaning material 34 is also temporarily affixed about a portion of the upper face 40.

Figure 4:
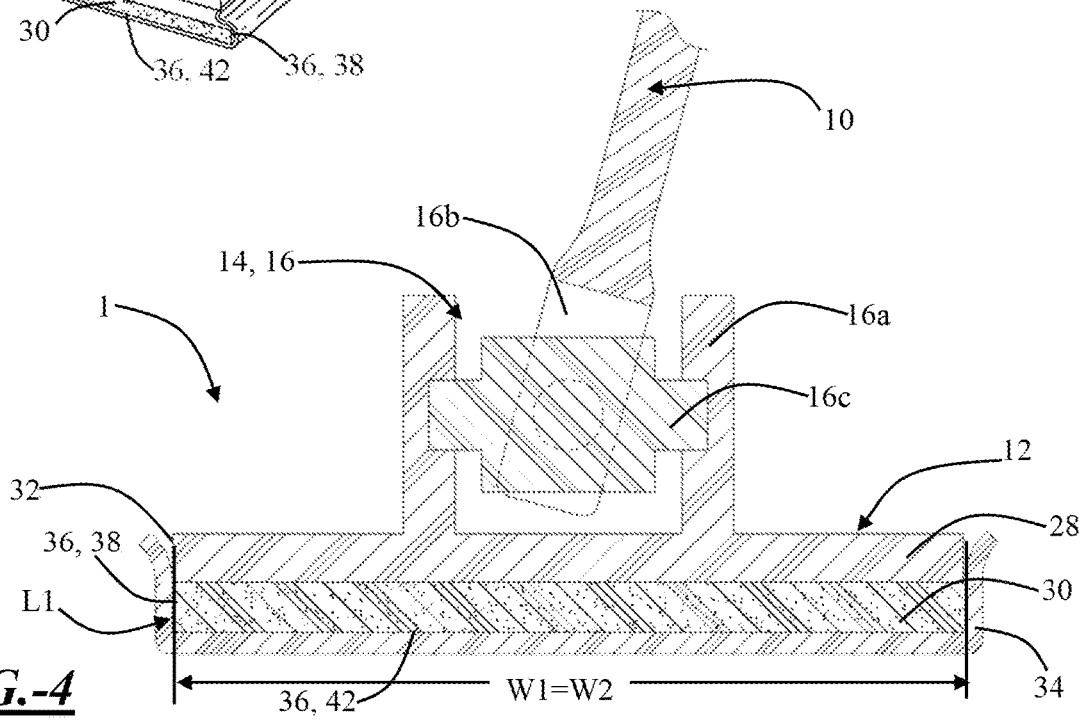
FIG. 4 is a cross-section view of a cleaning head of a handheld cleaning apparatus.

FIG. 4 is a cross-section of a cleaning apparatus 1. The cleaning apparatus 1 includes a handle 10 affixed to a cleaning head 12. The handle 10 is affixed to the cleaning head 12 via a joint 14. The joint 14 is illustrated as a universal joint 16. The joint 14 includes a base hinge 16*a* and a handle hinge 16*b* connected via a shaft 16*c*. The joint 14 affixed to a base 28. The cleaning head 12 includes a body 30. The body 30 is shown as a foam material. The body 30 has a width W1 about equal to a width W2 of the base 28. The body 30 is flush with the periphery 32 of the base 28. Attached and adjacent to the body 30 is a cleaning material 34. The cleaning material 34 is located on the body 30 opposite of the base 28. The cleaning material 34 is temporarily attached to the body 30. The cleaning material 34 is temporarily affixed to at least some of the plurality of faces 36 of the body. The cleaning material 34 is temporarily affixed to the lower face 42 and some of the side faces 38. Specifically, the cleaning material 34 is affixed to the two side faces 38 along the length LI of the body 30. The cleaning material 34 clings to the body 30 to provide for the temporary attachment.

Figure 5:
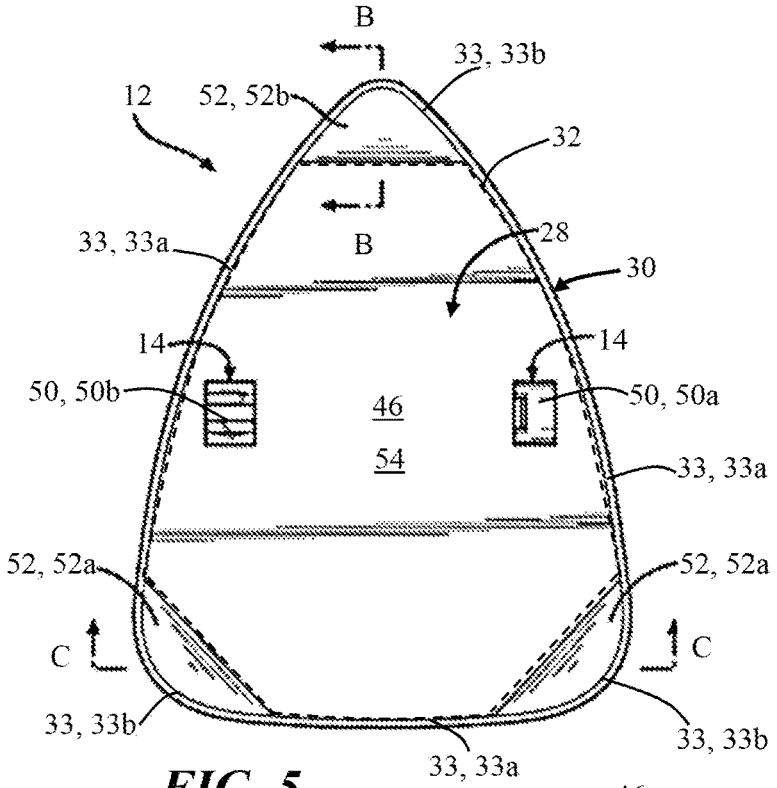
FIG. 5 is a top-view of a base of a cleaning head.
Figure 6:
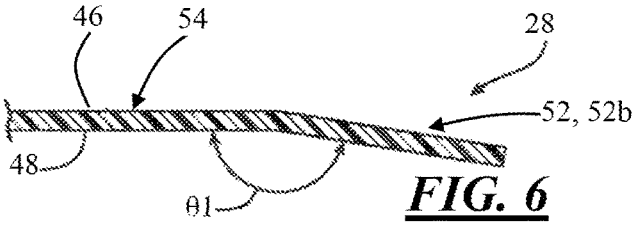
FIG. 6 is a cross-section view of a base taken along lines B-B of FIG. 5.

FIG. 5 illustrates a base 28 and body 30 of a cleaning head 12. The base 28 has an upper surface 46 opposite a bottom surface 48 (not shown). The body 30 is adjacent to the bottom surface 48 (not shown). The upper surface 46 has one or more portions of the joint 14 extending therefrom. As shown the joint 14 includes receivers 50. The receivers 50 include a hollow receiver 50*a* and a snap receiver 50*b*. The base 28 includes a periphery 32. The periphery 32 is defined by a continuous peripheral edge 33. The peripheral edge 33 includes a plurality of side edges 33*a* and corner edges 33*b*. The side edges 33*a* extend between and connect the corner edges 33*b*. The side edges 33*a* are substantially linear and/or less arcuate than the corner edges 33*b*. The side edges 33*a* define a central portion 54. The central portion 54 is further emphasized by the used of a broken line. The upper surface 46 and bottom surface 48 are substantially planar within the central portion 54. The corner edges 33*b* define a plurality of corners 52. The base 28 includes a plurality of corners 52. The corners 52 are bent downward. Specifically, the corner edges 33*b* at the corners 52 angle downward relative to the plurality of side edges 33*a* so that the corners 54 of the base 12 are positioned at an angle θ1 (such as shown in FIG. 6), which is a downward angle, relative to the upper surface 46 and/or bottom surface 48 (not shown) of the central portion 54. The corners 52 include two rounded corners 52*a*. The corners 52 also include one tip 52*b*. The tip 52*b* has a narrower angle and/or smaller radius formed by its corner edge 33*b* than the respective corner edges 33*b* at the rounded corners 52*a*.

FIG. 6 illustrates a cross-section of the base 28 taken at the tip 52*b* and apart of the central portion 54. The base 28 includes an upper surface 46 opposite a bottom surface 48. The tip 52*b* angles downward at angle θ1 relative to the upper surface 46 and bottom surface 48 of the central portion 54.

Figure 7:
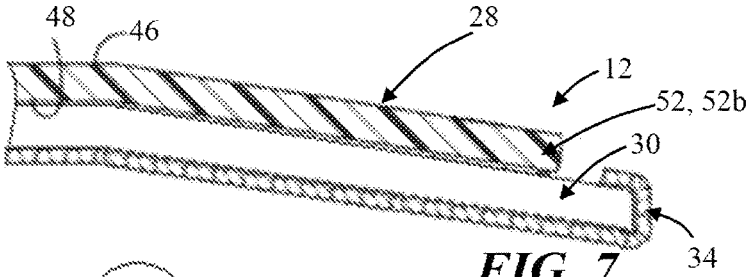
FIG. 7 is a cross-section view taken along lines B-B of FIG. 5 and also including a body and cleaning material as part of the cleaning head.

FIG. 7 illustrates a cross-section of the cleaning head 12 taken at the tip 52*b* and a part of the central portion 54. The cleaning head 12 includes a base 28, body 30, and cleaning material 34. The base 28 includes an upper surface 46 opposite a bottom surface 48. The upper surface and bottom surface 48 angle downward at the tip 52*b*. The body 30 also angles downward such that it has a reciprocal contour to the base 28. The cleaning material 34 is affixed to the body 30.

Figure 8:
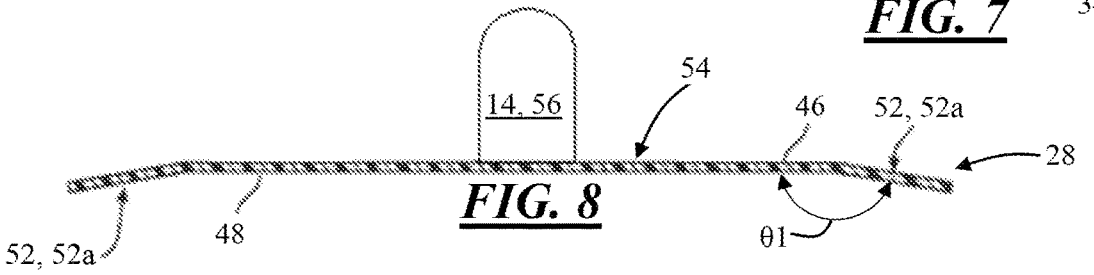
FIG. 8 is a cross-section view of a base taken along lines C-C of FIG. 5.

FIG. 8 illustrates a cross-section of the base 28 taken at the rounded tips 52*a* and into the central portion 54. The base 28 includes an upper surface 46 opposite a bottom surface 48. The rounded corners 52*a* angle downward at angle θ1 relative to the upper surface 46 and bottom surface 48 of the central portion 54. The base 28 includes a portion of a joint 14 extending therefrom. The joint 14 may include a hinge 56. The hinge 56 may be integrally formed as part of the base 48 or affixed thereto. The hinge 56 may be configured to be part of a universal joint 16 (not shown).

Figure 9:
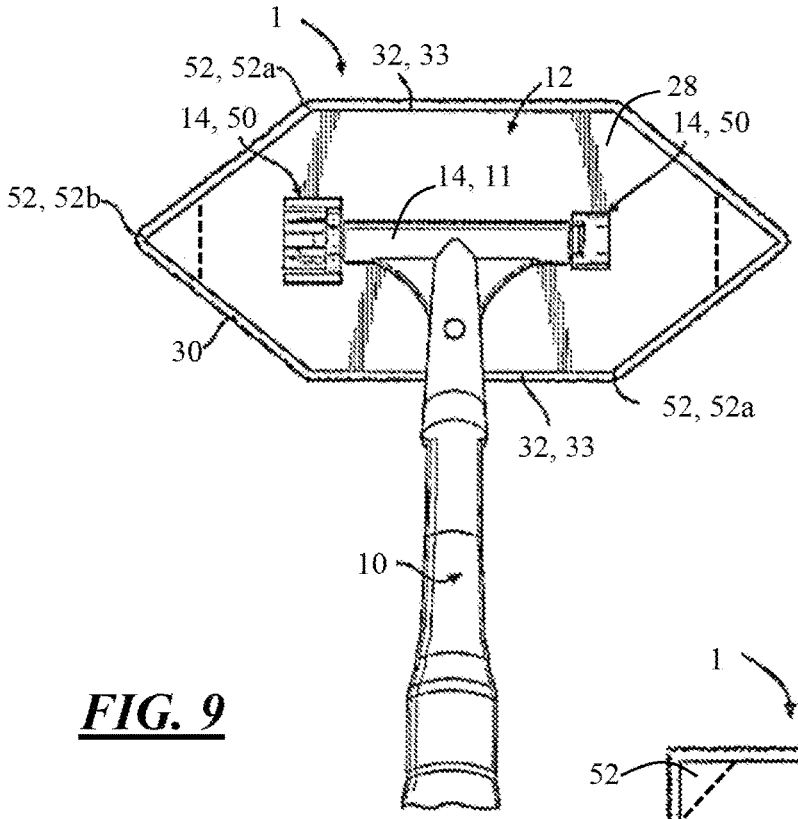
FIG. 9 illustrates a top view of a cleaning head.
Figure 10:
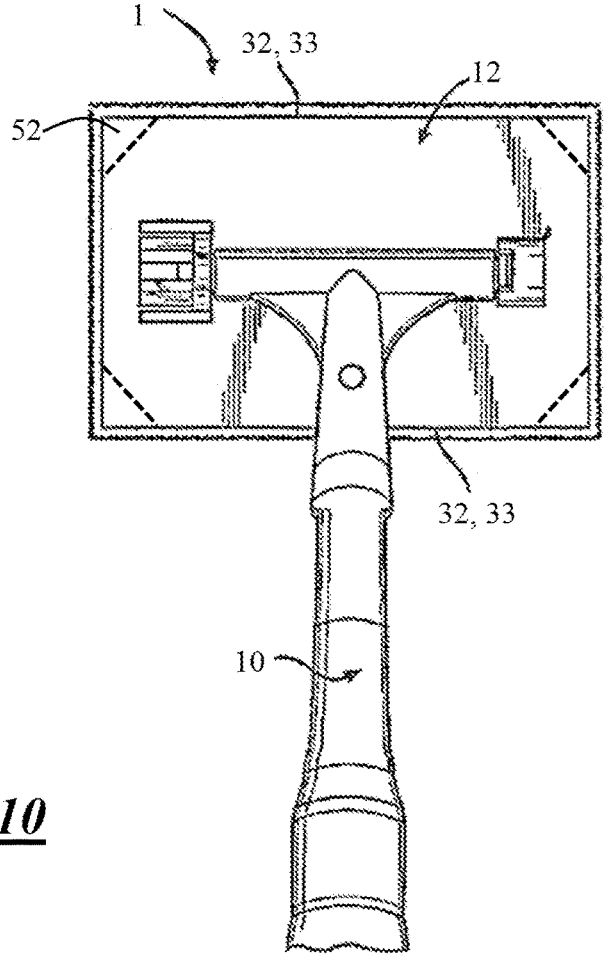
FIG. 10 illustrates a top view of a cleaning head.

FIGS. 9 and 10 illustrate atop plan view of a cleaning apparatus 1. The cleaning apparatus 1 includes a handle 10 affixed to a cleaning head 12. The cleaning head 12 includes a joint 14. The joint 14 is comprised of a pair of receivers 50 affixed to a base 28. The joint 14 also includes a shaft 11 as part of the handle 10. The base 28 is part of the cleaning head 12. In FIG. 9, the base 28 is illustrated as having a two-dimensional profile which is six-sided or similar to a hexagon. In FIG. 10, the base 28 is illustrated as having a two-dimensional profile which is rectangular. The base 28 includes a periphery 32 with peripheral edges 33. The base 28 includes a plurality of corners 52. Some of the corners 52 are rounded corners 52*a* while others are tips 52*b* as shown in FIG. 9. Some of the corners 52 are at a downward angle (shown by dashed line) compared to the remainder of the body 28. The cleaning head 12 includes a body 30. The body 30 is shown as extending past the periphery 32 of the base 28, but may also be flush, such as shown in FIG. 4.

Any numerical values recited in the above application include all values from the lower value to the upper value in increments of one unit provided that there is a separation of at least 2 units between any lower value and any higher value. These are only examples of what is specifically intended and all possible combinations of numerical values between the lowest value, and the highest value enumerated are to be considered to be expressly stated in this application in a similar manner. Unless otherwise stated, all ranges include both endpoints and all numbers between the endpoints.

The terms "generally" or "substantially" to describe angular measurements may mean about +/−10° or less, about +/−5° or less, or even about +/−1° or less. The terms "generally" or "substantially" to describe angular measurements may mean about +/−0.01° or greater, about +/−0.1° or greater, or even about +/−0.5° or greater. The terms "generally" or "substantially" to describe linear measurements, percentages, or ratios may mean about +/−10% or less, about +/−5% or less, or even about +/−1% or less. The terms "generally" or "substantially" to describe linear measurements, percentages, or ratios may mean about +/−0.01% or greater, about +/−0.1% or greater, or even about +/−0.5% or greater.

The term "consisting essentially of" to describe a combination shall include the elements, ingredients, components, or steps identified, and such other elements ingredients, components or steps that do not materially affect the basic and novel characteristics of the combination. The use of the terms "comprising" or "including" to describe combinations of elements, ingredients, components, or steps herein also contemplates embodiments that consist essentially of the elements, ingredients, components, or steps.

Plural elements, ingredients, components, or steps can be provided by a single integrated element, ingredient, component, or step. Alternatively, a single integrated element, ingredient, component, or step might be divided into separate plural elements, ingredients, components, or steps. The disclosure of "a" or "one" to describe an element, ingredient, component, or step is not intended to foreclose additional elements, ingredients, components, or steps.

What is claimed is:

1. A cleaning apparatus comprising:

a) a handle; and b) a cleaning head having:

i) a base pivotably connected to the handle, wherein the base has a two-dimensional profile shape, wherein the base includes a bottom surface opposing an upper surface, and wherein the base is pivotably connected to the handle at the upper surface;

ii) a body affixed to the bottom surface of the base and opposite the handle, wherein the body is formed of a compressible material, and wherein the body has a two-dimensional profile shape which is the same as the two-dimensional profile shape of the base;

iii) one or more cleaning materials removably secured via clinging directly to the compressible material of the body and opposite of the base while being free of direct attachment to the base; and wherein the cleaning head is free of any additional attachments and attachment aids such that the one or more cleaning materials are removably secured to the compressible material solely via clinging;

wherein the body comprises one or more body materials, and the one or more body materials comprise one or more foams, sponges, hook and loop material, or a combination thereof, and wherein the one or more cleaning materials include one or more inorganic materials organic materials, or both, and wherein the one or more cleaning materials comprise a plurality of fibers; and wherein the clinging is due to attraction and attachment of the plurality of fibers of the one or more cleaning materials to the one or more body materials at one or more faces of the body.

2. The cleaning apparatus of claim 1, wherein the one or more body materials include the one or more foams which are one or more open-cell foams.

3. The cleaning apparatus of claim 2, wherein the one or more body materials include the one or more foams which are porous with a porosity of about 30 ppi to about 100 ppi.

4. The cleaning apparatus of claim 2, wherein the one or more body materials have a thickness of about 0.1875 inches to about 0.5 inches.

5. The cleaning apparatus of claim 1, wherein the one or more body materials include the one or more foams comprising one or more polymeric materials including polyol, isocyanates, polyurethane (PUR), polystrene (PS), polyvinyl chloride (PVC), polyethylene (PE), silicone, acrylonitrile butadiene styrene (ABS), compounds thereof, or any combination thereof.

6. The cleaning apparatus of claim 5, wherein the one or more body materials comprise an ether-based polyurethane.

7. The cleaning apparatus of claim 1, wherein the one or more cleaning materials are washable and adapted to be reused, single-use, biodegradable, or a combination thereof.

8. The cleaning apparatus of claim 1, wherein the one or more cleaning materials include one or more polymeric materials which include polyamide, polyester, polystyrene, polyethylene, polycarbonates (PC), polypropylene, polyvinyl chloride, bio-based plastics/biopolymers, silicone, acrylonitrile butadiene styrene (ABS), or any combination thereof.

9. The cleaning apparatus of claim 1, wherein the one or more cleaning materials include a microfiber, a spunlace, or both; and wherein the one or more cleaning materials are woven, nonwoven, or both.

10. The cleaning apparatus of claim 9, wherein the one or more cleaning materials include a split-microfiber.

11. The cleaning apparatus of claim 1, wherein the base is pivotally connected to the handle via an onmidirectional joint; and wherein the omnidirectional joint is a universal joint.

12. The cleaning apparatus of claim 1, wherein the handle has a length which is adjustable.

13. The cleaning apparatus of claim 12, wherein the handle includes a plurality of handle portions for adjusting the length of the handle.

14. The cleaning apparatus of claim 1, wherein the two-dimensional profile shape of the base is substantially a square, rectangle, triangle, pentagon, trapeze, polygon, hexagon, octagon, rhombus, or any combination thereof; and wherein the base includes one or more corners as part of the two-dimensional profile shape.

15. The cleaning apparatus of claim 14, wherein at least one of the one or more corners is angled downward such that a peripheral edge, the upper surface, and the bottom surface at the one or more corners is angled downward relative to the peripheral edge, the bottom surface, and the upper surface part of a central portion of the base.

16. A kit for a cleaning apparatus comprising:

a) a handle;

b) a cleaning head having:

i) a base configured to be pivotably connected to the handle, wherein the base has a two-dimensional profile shape, wherein the base includes a bottom surface opposing an upper surface, wherein the base is pivotably connected to the handle at the upper surface, and wherein the two-dimensional profile shape is a shape which includes at least one or more corners, and wherein at least one of the one or more corners is angled downward away from the handle and relative to a central portion of the base;

a body affixed to the bottom surface of the base and configured to be opposite the handle, wherein the body is formed of a compressible material, wherein the body has a two-dimensional profile shape which is the same as but larger than the two-dimensional profile shape of the base such that an upper face of the body, which is affixed to the bottom surface of the base, projects away from and is exposed from the base;

c) one or more cleaning materials configured to be removably secured via clinging directly to the compressible material of the body and opposite of the base while being free of direct attachment to the base; and wherein the cleaning head is free of any additional attachments and attachment aids such that the one or more cleaning materials are removably securable to the compressible material solely via clinging;

wherein the body comprises one or more body materials, and the one or more body materials comprise one or more foams, sponges, hook and loop material, or a combination thereof; and wherein the one or more cleaning materials include one or more inorganic materials, organic materials, or both, and wherein the one or more cleaning materials comprise a plurality of fibers; and wherein the clinging is due to attraction and attachment of the plurality of fibers of the one or more cleaning materials to the one or more body materials at one or more faces of the body, including at a bottom face opposite the upper face and at the upper face where exposed from the base.

17. The kit of claim 16, wherein the two-dimensional profile shape of the base and the body is substantially a square, rectangle, triangle, pentagon, trapeze, polygon, hexagon, octagon, rhombus, or any combination thereof;

wherein the two-dimensional profile shape of the body is substantially the same as the two-dimensional profile shape of the base; and wherein the base includes the one or more corners as part of the two-dimensional profile shape.

18. The kit of claim 16, wherein the one or more body materials include the one or more foams which are one or more open-cell foams; and wherein the one or more body materials include the one or more foams which are porous with a porosity of about 30 ppi to about 100 ppi.

19. The kit of claim 18. wherein the one or more cleaning materials include a microfiber, a spunlace, or both; and wherein the one or more cleaning materials are woven, nonwoven, or both.

20. A method for using a cleaning apparatus for cleaning a surface comprising:

a) assembling the cleaning apparatus, including applying one or more cleaning materials to a body; such that the one or more cleaning materials are removably secured via clinging to the body and free of direct attachment to a base, wherein the cleaning apparatus includes:

i) a handle; and ii) a cleaning head having:

the base pivotably connected to the handle, wherein the base has a two-dimensional profile shape, wherein the base includes a bottom surface opposing an upper surface, wherein the base is pivotably connected to the handle at the upper surface, and wherein the two-dimensional profile shape is a shape which includes at least one or more corners which are angled downward away from the handle and relative to a central portion of the base;

the body affixed to the base and opposite the handle, wherein the body is formed of a compressible material, wherein the body has a two-dimensional profile shape which is the same but larger than the two-dimensional profile shape such that an upper face of the body, which is affixed to the bottom surface of the base, projects away from and is exposed from the base; and the one or more cleaning materials; and b) cleaning the surface by wiping, sweeping, dusting, mopping, scrubbing, polishing, or a combination thereof with the one or more cleaning materials;

wherein the body comprises one or more body materials, and the one or more body materials comprise one or more foams, sponges, hook and loop material, or a combination thereof;

wherein the one or more cleaning materials include one or more inorganic materials, organic materials, or both, and wherein the one or more cleaning materials comprise a plurality of fibers; and wherein the clinging is due to attraction and attachment of the plurality of fibers of the one or more cleaning materials to the one or more body materials at one or more faces of the body, including at a bottom face opposite the upper face and at the upper face where exposed from the base.

* * * * *